US005860371A

United States Patent [19]

Shelley

[11] Patent Number: 5,860,371

[45] **Date of Patent: *Jan. 19, 1999**

[54] SECURITY WINDOW ADAPTED TO PREVENT FORCED ENTRY

[75] Inventor: Michael K. Shelley, Greenville, N.C.

[73] Assignee: Protec Company, Greenville, N.C.

[ * ] Notice: The term of this patent shall not extend beyond the expiration date of Pat. No. 5,636,579.

[21] Appl. No.: 866,806

[22] Filed: May 30, 1997

Related U.S. Application Data

[63] Continuation-in-part of Ser. No. 379,727, Jan. 27, 1995, Pat. No. 5,636,579.

[51] Int. Cl.[6] ..... E05G 7/00

[52] U.S. Cl. ..... 109/11; 49/73.1; 49/125; 49/360; 109/12; 109/15; 109/17

[58] Field of Search ..... 109/2, 5, 10–18; 49/73.1, 125, 360; 160/190, 193, 202

[56] References Cited

U.S. PATENT DOCUMENTS

| | | | |
|---|---|---|---|
| 562,712 | 6/1896 | DeLong | 109/17 |
| 774,190 | 11/1904 | Liberty | 109/17 |
| 1,193,908 | 8/1916 | McCloud . | |
| 1,197,317 | 9/1916 | Wexler . | |
| 1,238,704 | 8/1917 | Wendelken | 49/125 |
| 1,258,297 | 3/1918 | Arnold | 109/17 |
| 1,382,803 | 6/1921 | Robbins et al. . | |
| 1,435,038 | 11/1922 | Wood | 109/17 |
| 1,546,848 | 7/1925 | Lundgren | 109/17 |
| 1,623,674 | 4/1927 | Hagestedt . | |
| 1,777,760 | 10/1930 | Murray . | |
| 1,863,680 | 6/1932 | Young et al. . | |
| 1,982,247 | 11/1934 | Foley | 109/17 |
| 2,320,604 | 6/1943 | Jackson et al. | 268/30 |
| 2,908,051 | 10/1959 | Sparkes | 20/19 |
| 2,984,194 | 5/1961 | Jennings | 109/4 |
| 3,067,700 | 12/1962 | O'Meara et al. | 109/12 |
| 4,034,685 | 7/1977 | Word | 109/17 |
| 4,748,914 | 6/1988 | Cardinal | 109/17 |
| 4,826,264 | 5/1989 | Cass | 312/312 |
| 4,831,939 | 5/1989 | Cardinal | 109/17 |
| 4,984,387 | 1/1991 | Wheatland | 49/360 X |
| 5,636,579 | 6/1997 | Shelley | 109/11 |

FOREIGN PATENT DOCUMENTS

| | | | |
|---|---|---|---|
| 0276650 | 8/1988 | European Pat. Off. | 109/12 |
| 2397688 | 3/1979 | France | 109/17 |
| 2444459 | 4/1975 | Germany | 109/17 |
| 1176405 | 1/1970 | United Kingdom | 109/12 |

OTHER PUBLICATIONS

Sales brochure from Protec Company.

*Primary Examiner*—Lloyd A. Gall
*Attorney, Agent, or Firm*—Jenkins & Wilson, P.A.

[57] ABSTRACT

A security window having one or more vertically movable panels, suitably of a transparent, rigid plastic that is bullet-resistant. The security window is useful for a clerk in a convenience store. The security window is provided with a safety mechanism that is operatively associated with the one or more vertically movable panels, and prevents direct vertical manual movement thereof by a would-be robber.

24 Claims, 16 Drawing Sheets

SECURITY WINDOW ADAPTED TO PREVENT FORCED ENTRY

RELATION APPLICATIONS

This application is a Continuation-in-Part of copending application Ser. No. 08/379,727, filed Jan. 27, 1995, U.S. Pat. No. 5,636,579.

TECHNICAL FIELD

The present invention relates generally to a novel security window, particularly useful for a module, kiosk, or portion of a wall, in order to protect a clerk on one side of the window from a robber on the other side of the window. More particularly, the present invention relates to such a novel security window that has one or more vertically movable panels, and a safety mechanism, whereby direct vertical manual movement of the movable panel(s) is prevented, whether the window is completely open, partially opened or closed, or completely closed.

RELATED ART

There are many devices in the prior art for moving a door or window panel. Such panels are used, for instance, in a sliding door (connecting a house to a patio), a bank teller's security cage, a garage, and an elevator.

In general, the prior devices relating to security cages for bank clerks have one moving panel that closes "instantaneously", i.e., extremely quickly in about 0.5 second or less. Thus, the cage is useful for the emergency situation when a robber is confronting the clerk. Since the cage is not kept closed during the work day as transactions take place between the clerk and legitimate customers, there is no necessity for the panel to be made of a transparent, bullet-resistant plastic or glass window, and the panel typically is an opaque steel shield.

However, over the last decade or so, the need has been increasing for a security enclosure for night shift clerks in a business that stays open 24 hours per day, for instance, a small grocery store (colloquially known as a "convenience store"), a hotel, or a motel, since the majority of robberies at such businesses occur during the nighttime. For these businesses, there is a need for a transparent panel that can be closed within several seconds, for instance about 7 to 10 seconds, so that the clerk will be able to choose when to close the panel to be secure during the nighttime, and yet have the ability to see and to perform transactions with legitimate customers who come into the business during the nighttime. During the daytime when the risk of robberies is less, the panel can be left open to promote a friendly atmosphere. In other words, the need for security provided by a movable panel that closes instantaneously when a bank clerk is confronted by a robber during regular, daytime working hours differs from the need for security for the clerk in a business open all night long.

An example of a security window useful in a business that is open 24 hours per day is described in a sales and advertising brochure entitled "If the Thought of This Scares You . . ." from Protec Company of Greenville, N.C. Illustrated in this brochure is Protec's SECURE-SELL™ brand of an electrically operated retractable ballistic barrier security window, which is shown disposed in a module situated inside of a convenience store. As can be seen in the brochure, when the module is in an open position, its one moveable panel is in the countertop. Then, activation of a battery operated electric motor causes upward movement of the one moveable panel toward the roof of the module in order to close the module. Because of this feature, a transaction tray for the clerk and the customer to pass money and goods back and forth obviously cannot be placed in the portion of the countertop in which the panel moves. Accordingly, the module may be provided with one or more additional transparent, bullet-resistant, stationary panels in line with and on either or both side of the opening for the one movable panel so that there is a transaction device disposed in or on the countertop underneath each one of these stationary panels.

Additionally, of interest is U.S. Pat. No. 4,034,685, issued in 1977 to Word. This patent is directed to a bank teller's security closure having a vertically extending shield mounted relative to a teller's cage and adapted to be moved from an open, top position to a bottom, closed position so that access to the teller's cage, such as by a potential robber, is unobtainable. The moving shield may be constructed of bullet-proof glass, and is moved downwardly to the closed position by two cables, one disposed in each side channel of the cage. Each cable is wound around an upper and lower pulley. Besides an electrical activating means, the teller's shield has a manual activating means that is capable of operating upon failure of electrical power so that the shield may be lowered to the closed position, in the event of a power failure or the event of a robber disconnecting the power.

Of some relevance are U.S. Pat. No. 1,777,760, issued in 1930 to Murray, and U.S. Pat. No. 4,826,264, issued in 1989 to Cass, both of which involve a security closure for a bank teller's cage. However, in contrast to the device in the patent to Word, the devices in these two patents involve multiple-panel, steel shutters that have lips on their edges for the purpose of interlinking and uniting them in a shingled relationship when the teller's cage is closed. In the patent to Murray, the steel panels move downwardly from an upper position to a lower position for the cage to be closed, whereas in the patent to Cass, the steel panels rise upwardly from a lower position to an upper position for the cage to be closed.

Somewhat similar is U.S. Pat. No. 2,908,051, issued in 1959 to Sparkes, which shows a window assembly having a plurality of window panels in shingled relationship, with the uppermost panel fixed at the top of the assembly. The remainder of the panels are vertically slidable. When the window is open, the panels are evenly stacked in superposed formation. As the slidable panels move from the open, top position, each succeeding movable panel is free to move downwardly from the top throughout its separate path independently of the immediately preceding panel to effect closure of the window. Moreover, like the steel panels in the above-mentioned patent to Murray and patent to Cass, the panels in the patent to Sparkes have lips on their edges so that the panels interlock by engaging respective edges as the panels move downwardly from the open, top position to the closed position. The panels are suitably manufactured from a lightweight plastic.

Also, of background interest is U.S. Pat. No. 2,320,604, issued in 1943 to Jackson et al., which shows two or more telescoping door panels that can be lowered from the ceiling to the floor vis-a-vis a plurality of pulleys secured equidistantly along a shaft, each pulley being provided with a lifting cable. The bottom ends of the lifting cables are attached to the top edges of the panel, and each cable has a pair of cylinders and pistons to equalize tension so that each panel can be operated evenly. The telescoping door panels are useful in aircraft hangers.

A number of other devices, illustrated in U.S. Pat. No. 1,193,908, issued in 1916 to McCloud; U.S. Pat. No. 1,197,317, issued in 1916 to Wexler; U.S. Pat. No. 1,258,297, issued in 1918 to Arnold; U.S. Pat. No. 1,382,803, issued in 1921 to Robbins et al.; U.S. Pat. No. 1,623,674, issued in 1927 to Hagestedt; U.S. Pat. No. 1,863,680, issued in 1932 to Young et al.; U.S. Pat. No. 2,984,194, issued in 1961 to Jennings; and U.S. Pat. No. 3,067,700, issued in 1962 to O'Meara et al. are also of some background interest vis-a-vis movable panels.

SUMMARY AND OBJECTS OF THE INVENTION

Therefore, the present invention provides a security window comprising a frame, a vertically extending fixed panel, a vertically extending movable panel assemblage, a counterbalancing arrangement, a mounting mechanism, an activator, and a safety mechanism.

The frame has a roof member, a first side member, and a second side member. Also, the vertically extending fixed panel is fixedly mounted adjacent to the roof member, and the fixed panel has a top edge, a bottom edge, a first side edge, and a second side edge.

The vertically extending movable panel assemblage comprises at least one movable panel slidably mounted in the frame and adapted to be vertically moved between an upper opened position and a lower closed position. The movable panel has a top edge, a bottom edge, a first side edge, and a second side edge. The counterbalancing mechanism for the movable panel assemblage includes at least a primary counterweight.

The mounting mechanism is operatively associated with the frame to permit vertical movement of the movable panel in a path that defines a plane substantially parallel to the plane defined by the fixed panel. The mounting mechanism preferably includes a first shaft, a first and a second sprocket, and a first and a second chain. The first shaft has a first end and a second end. The first shaft is operatively associated with the first movable panel, and is supported for rotational movement adjacent the roof member of the frame. The first and the second sprockets are disposed, respectively, at the first and the second ends of the first shaft. The first and the second chains are (i) connected, respectively, to the first and the second side edges of the first movable panel, (ii) connected to the primary counterweight, and (iii) wound, respectively, over the first and the second sprockets.

The activator is operatively associated with the movable panel assemblage, such that engagement of the activator allows for vertical movement thereof, and the safety mechanism is operatively associated with the movable panel assemblage and adapted to prevent direct vertical manual movement thereof.

Moreover, in an alternative embodiment, the present invention provides a security window adapted for mounting on a countertop, wherein the security window comprises a frame, a vertically extending fixed panel, a vertically extending movable panel assemblage, a counterbalance, a mounting mechanism, an activator, and a safety mechanism.

The frame has a roof member, a first side member, and a second side member. Also, the vertically extending fixed panel is fixedly mounted adjacent to the roof member. The fixed panel has a top edge, a bottom edge, a first side edge, and a second side edge.

The vertically extending movable panel assemblage comprises at least one movable panel slidably mounted in the frame and adapted to be vertically moved between an upper open position in superposed registration with the fixed panel and a lower closed position vertically below the fixed panel. The at least one movable panel has a top edge, a bottom edge, a first side edge, and a second side edge.

The counterbalance is for the movable panel assemblage and includes a primary counterweight assemblage comprising a first and a second equally sized counterweight vertically disposed, respectively, in each of the first and second side members of the frame. Preferably, the first and second primary counterweights are both exclusively in the respective first and second side members.

The mounting mechanism is operatively associated with the frame to permit vertical movement of the at least one movable panel in a path that defines a plane substantially parallel to the plane defined by the fixed panel. The mounting mechanism includes a first shaft, a first and a second sprocket, and a first and a second chain. The first shaft has a first end and a second end, and also is operatively associated with the at least one movable panel and is supported for rotational movement adjacent the roof member of the frame. The first and the second sprockets are disposed, respectively, at the first end and the second end of the first shaft. The first and the second chains are connected, respectively, to the first and the second side edges of the at least one movable panel. Also, the first and the second chains are connected to the first and the second equally sized primary counterweights, and wound, respectively, over the first and the second sprockets.

The activator is operatively associated with the movable panel assemblage, such that engagement of the activator with the mounting mechanism allows for vertical movement of the at least one movable panel. Also, the safety mechanism is operatively associated with the movable panel assemblage and adapted to prevent direct vertical manual movement of the at least one movable panel.

Preferably, for the above-described alternative embodiment, each of the first and second chains is a unidirectional chain which will, when fixed at two spaced-apart points along the chain and defining a portion therebetween along the chain, become rigid in the portion of the chain between the two points to prevent buckling in that portion during attempted direct vertical manual movement of the at least one movable panel.

When each of the first and second chains is a unidirectional chain, the safety mechanism does not need to include a first channel for the first chain and a second channel for the second chain, with the channels being disposed in the respective first and second side members. However, the safety mechanism does include a first and a second arcuate-shaped block respectively disposed in each of the first and the second side members, with the first and the second blocks being respectively positioned above each of the first and the second sprockets to prevent each of the first and the second chains from being lifted off its associated sprocket during attempted direct vertical manual movement of the at least one movable panel.

Additionally, for the above-described alternative embodiment, the movable panel assemblage may further comprise a second vertically extending movable panel slidably mounted in the frame and adapted to be vertically moved between an upper open position and a lower closed position, and the second movable panel having a top edge, a bottom edge, a first side edge, and a second side edge.

Then, in this situation where a second vertically extending movable panel is present, the counterbalance further includes a secondary counterweight assemblage comprising a first and a second equally sized counterweight vertically disposed, respectively, in each of the first and the second side members of the frame. Also, the mounting mechanism further includes a second shaft, a third and a fourth sprocket, and a third and a fourth chain. The second shaft is operatively associated with the second movable panel, supported for rotational movement adjacent the roof member, and has a first end and a second end. The third and the fourth sprockets are disposed, respectively, at the first end and the second end of the second shaft. The third and the fourth chains are connected, respectively, to the first and the second side edges of the second movable panel. Also, the third and the fourth chains are connected, respectively, to the first and the second equally sized secondary counterweights, and wound, respectively, over the third and the fourth sprockets.

Accordingly, it is an object of the present invention to provide a security window having one or more vertically moveable panels that can be moved downwardly to close the window and protect a user from a robber.

It is another object of the present invention to provide a security window that protects a user in that the window has a safety mechanism that will not allow for direct vertical manual movement of the moveable panel(s) of the window by a person, whether the security window is completely opened, partially opened or partially closed, or completely closed.

Thus, it is a feature of the present invention that when the security window is closed, a robber attempting direct vertical manual movement of the movable panel(s) will not be able to move them and open the security window.

Some of the objects of the invention having been stated above, other objects will become evident as the description proceeds, when taken in connection with the accompanying drawings as best described below.

DETAILED DESCRIPTION OF THE INVENTION

The discussion below is of the preferred embodiment of the invention as illustrated in FIGS. 1–9. The same numerals are used to depict the same elements in the different FIGS. 1–9.

Figure 1:
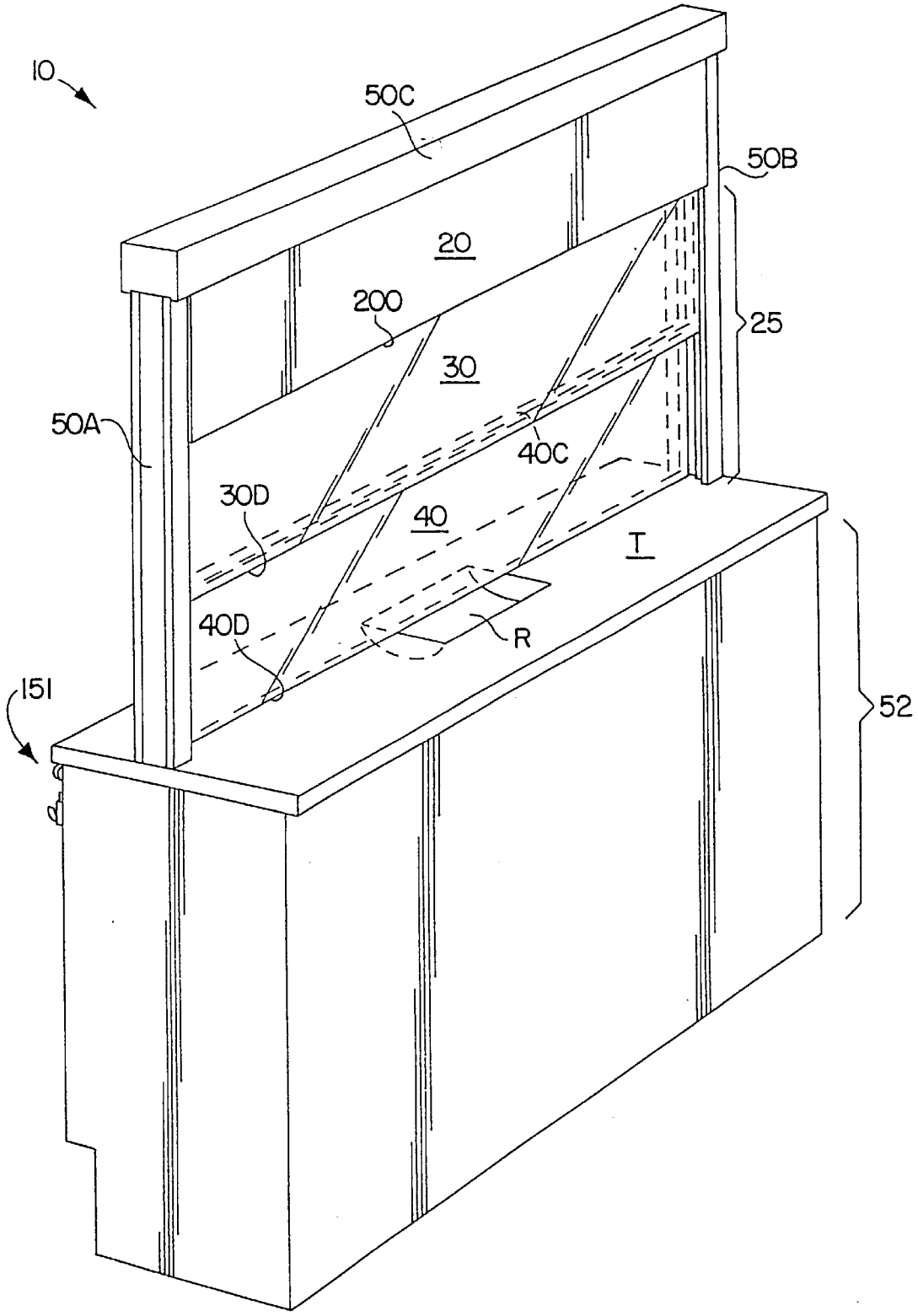
FIG. 1 is a front, perspective view of the novel security window of the present invention.
Figure 2:
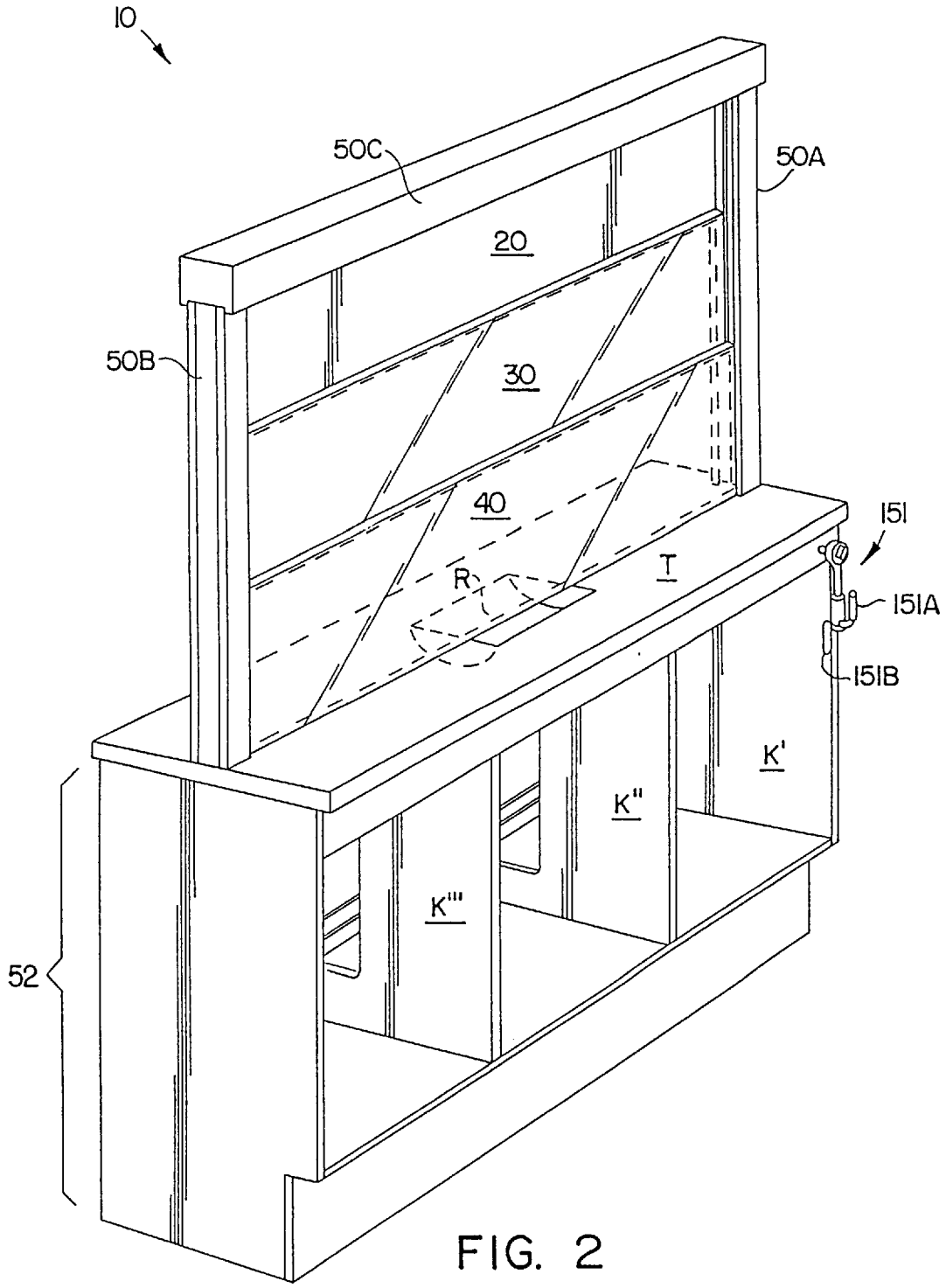
FIG. 2 is a rear, perspective view of the novel security window of FIG. 1.

More particularly, illustrated in FIG. 1 is a front perspective view of the inventive security window 10 in its closed position. FIG. 2 is similar to FIG. 1, except that FIG. 2 is a rear perspective view of security window 10.

Security window 10 has a transom or fixed panel 20 and a movable panel assemblage 25. Movable panel assemblage 25 comprises a first movable panel 30 and a second movable panel 40. As discussed in more detail below, the panels of assemblage 25 are adapted to move vertically downward from an upper open position to a lower closed position, and vice versa.

It is noted that although security window 10 is shown in its preferred embodiment with two movable panels 30 and 40, it is contemplated that security window 10 may have one movable panel or may have three or more movable panels as a matter of design choice.

Fixed panel 20 has a first side edge 20A, a second side edge 20B, a top edge 20C, and a bottom edge 20D. Likewise, first movable panel 30 has a first side edge 30A, a second side edge 30B, a top edge 30C, and a bottom edge 30D, and second movable panel 40 has a first side edge 40A, a second side edge 40B, a top edge 40C, and a bottom edge 40D.

Panels 20, 30, and 40 are most suitably positioned within a frame or framework 50, which has a first side member 50A, a second side member 50B, and a roof member 50C. Suitably, framework 50 is mounted on a countertop T of cabinet 52 having a recess R disposed therein. Recess R is illustrated as a transaction tray for passing items, particularly money, back and forth between a customer at the front to a clerk at the back of security window 10 when window 10 is in its closed position. Since movable panels 30 and 40 move in a downward direction to close window 10, as is further discussed below, recess R can be conveniently located directly beneath panels 20, 30, and 40. It is noted that recess R should be small so as not to allow room for a robber to slide his/her hand holding a gun under panels 30 and 40 when window 10 is in its closed position.

Furthermore, as can be seen in FIG. 2, optional storage compartments K', K", and K'" may be disposed beneath counter top T. Compartments K', K", and K'" are shown open to the back of cabinet 52 for a clerk working behind security window 10 to store items. Of course, depending on what is desired for the clerk, the compartments may have doors, and also more or fewer compartments, as well as compartments opening to the front of cabinet 52 to display items for purchase by a customer, may be provided.

During use, security window 10 may be a part of a wall of a room of a business, a module that sits upon the floor of a room of a business, or a combination thereof, in order to provide an enclosure for a user thereof, for instance, a clerk in a convenience store.

Panels 20, 30, and 40 and cabinet 52 should be bullet-resistant to afford protection to the clerk from a robber who has a gun. To provide such bullet-resistant characteristics to security window 10, cabinet 52 is lined with steel and each of panels 20, 30, and 40 is manufactured from a transparent material selected from bullet-resistant glass, bullet-resistant rigid plastic, or a combination thereof. The transparent material allows the clerk and customer to view each other therethrough when window 10 is in its closed position.

Preferable bullet-resistant rigid plastic for the panels may be purchased under the registered trademark LUCITE S-A-R II from ICI or DuPont. A bullet-resistant rigid plastic sold under the registered trademark LEXGARD from General Electric also may be employed, but this material is not as rigid as LUCITE S-A-R II. Thus, there is a possibility that a strong robber using a crowbar can horizontally pry apart two LEXGARD panels, which is extremely difficult to do to two LUCITE S-A-R-II panels. To avoid this problem if using LEXGARD panels, the panels should have a metal border (not illustrated) around the edges thereof. However, such a border can interfere with the clerk and customer easily viewing each other when window 10 is in its closed position.

Various sizes for security window 10 may be employed. The only requirements are that security window 10 is of an appropriate size to fit into the room of the business where it will be placed, and that the height of panels 20, 30, and 40 and the height of cabinet 52 are appropriate for average sized persons. For instance, when security window 10 is in the form of a module (not shown), the module will generally be a box-like shape about 5 to 10 feet (about 152 to 305 cm) deep, about 8 to 30 feet (about 487 to 549 cm) wide, and about 7.5 to 9 feet (about 229 to 274 cm) tall.

A typical size for each of panels 20, 30, and 40 is about 20 inches (about 51 cm) in vertical height, about 8 feet (about 244 cm) in horizontal length, and about 1.25 inches (about 3.2 cm) in thickness, and a typical weight is about 110 pounds (about 242 kg). From the top of roof member 50C to the bottom of cabinet 52 is generally about 8 feet (about 244 cm) in vertical height, and cabinet 52 is usually about 40 inches (about 101 cm) in vertical height with countertop T being about 30 inches (about 76 cm) deep.

However, if one movable panel is used instead of two, then generally the one movable panel will be about twice the 20 inches (51 cm) of vertical height and twice the 110 pound (242 kg) weight of either first movable panel 30 or second movable panel 40. In that situation, more space would be needed to move the one movable panel upwardly so that security window 10 would be in its open position, and hence, security window 10 would typically be at least about 9 feet (about 274 cm) from the top of roof member 50C to the bottom of cabinet 52.

Figure 3:
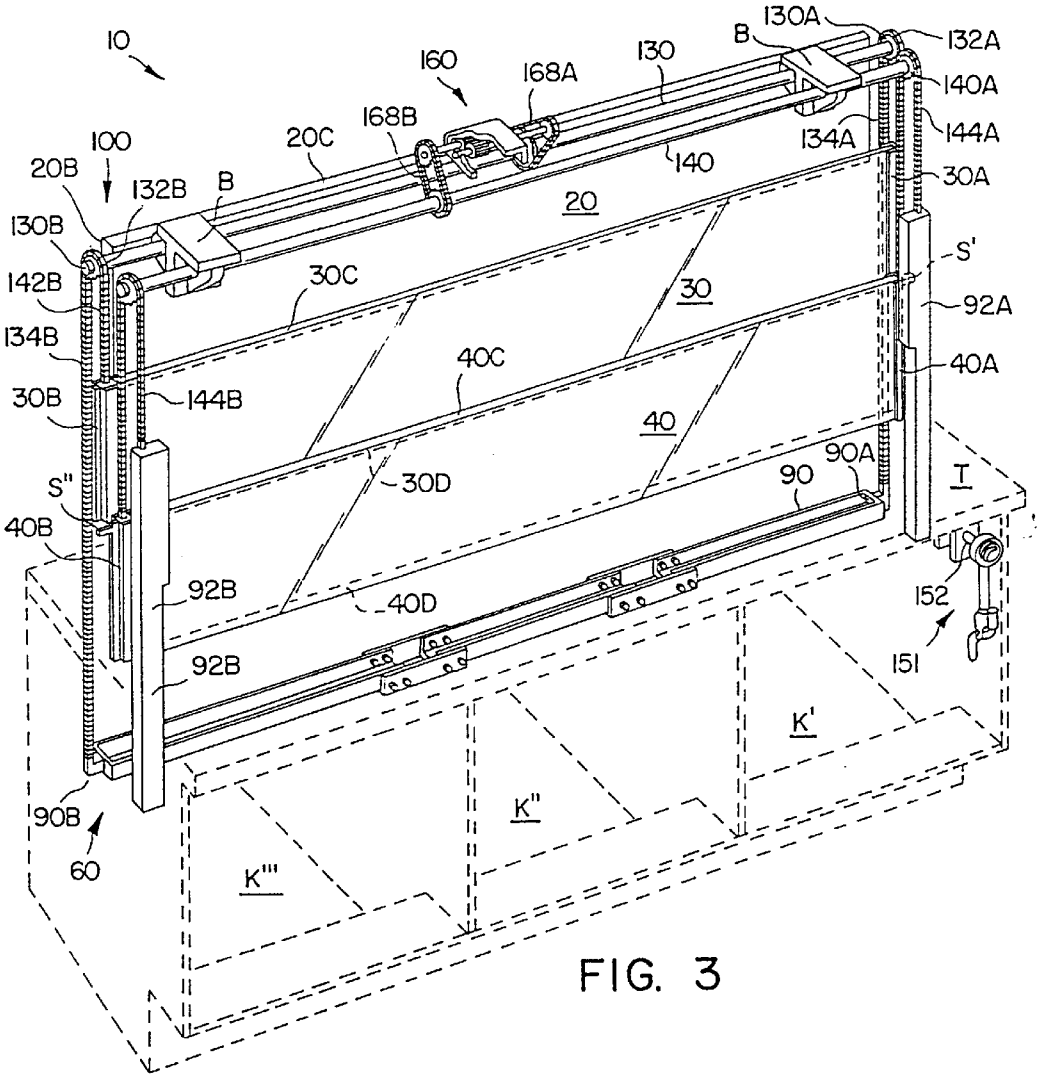
FIG. 3 is a rear, perspective view of the security window of FIG. 2, but showing the working mechanism in solid lines absent the frame and showing the associated counter in phantom lines for better clarity of understanding.

FIG. 3 is a view of security window 10 illustrating greater detail thereof than FIGS. 1 and 2 illustrate. For convenience in showing the greater detail, FIG. 11 does not show recess R.

More specifically with regard to FIG. 3, transom or fixed panel 20 is fixedly mounted at each edge 20A, 20B to first side member 50A and second side member 50B, respectively, of frame 50. Additionally, each of first edge 30A and second edge 30B of first movable panel 30 is slidably mounted, respectively, in first side member 50A and second side member 50B of frame 50, and similarly, each of first edge 40A and second edge 40B of second movable panel 40 is slidably mounted, respectively, in first side member 50A and second side member 50B of frame As a result, first and second movable panels 30, 40 are adapted to be vertically moved between a lower fully closed position (see FIGS. 4A and 4B) and an upper fully opened position (see FIGS. 5A and 5B). Movable panels 30, 40 can be moved vertically up or down, so that window 10 is fully open, partially opened or closed, or fully closed. First movable panel 30 and second movable panel 40 each vertically moves in a path defining a plane substantially parallel to the plane defined by fixed panel 20, and movement downwardly from the upper fully opened position to the lower fully closed position, or vice versa, takes about 5 to 7 seconds.

A counter balancing mechanism 60 is provided for each of the one or more movable panels, and includes a primary counterweight 90 for first movable panel 30. Primary counterweight 90 has a first end 90A and a second end 90B, and is horizontally disposed beneath panel 30, for instance, in cabinet 52, which can be thought of as the bottom member of frame 50. For second movable panel 40, counter balancing mechanism 60 may further include a secondary counterweight comprising two equally sized first and second counterweights 92A and 92B vertically disposed, respectively, in each of first side member 50A and second side member 50B of frame 50. By "equally sized" is meant that first and second equally sized counterweights 92A and 92B are generally of the same shape and same weight.

A mounting mechanism 100 is operatively associated with frame 50 to permit vertical movement of the one or more movable panels, each in a path defining a plane substantially parallel to the plane defined by fixed panel 20. Thus, mounting mechanism 100 includes a first shaft 130, a first and a second sprocket member 132A and 132B, and a first and a second chain 134A and 134B for first movable panel 30. Chain 134A is connected to shaft 152 of ratchet 151 in a conventional manner to be described in more detail below (see FIG. 4B). Ratchet 151 may be mounted on either side of window 10 as a matter of design choice.

First shaft 130 has a first end 130A and a second end 130B, and is operatively associated with first movable panel 30. First shaft 130 is supported for rotational movement adjacent roof member 50C in mounting blocks B.

First sprocket 132A and second sprocket 132B are disposed, respectively, at first end 130A and second end 130B of first rod 130. Also, first sprocket 132A and second sprocket 132B have wound thereover, respectively, first chain 134A and second chain 134B. First chain 134A and second chain 134B are connected, respectively, to first side edge 30A and second side edge 30B of first movable panel 30, and, respectively, to first end 90A and second end 90B of primary horizontally disposed counterweight 90.

For second movable panel 40, mounting mechanism 100 includes a second shaft 140, a third and a fourth sprocket 142A and 142B, and a third and a fourth chain 144A and 144B.

Second shaft 140 has a first end 140A and a second end 140B, and is operatively associated with second movable panel 40. Second shaft 140 is supported for rotational movement adjacent roof member 50C in mounting blocks B.

Third sprocket 142A and fourth sprocket 142B are disposed, respectively, at first end 140A and second end 140B of second rod 140. Third sprocket 142A and fourth sprocket 142B have wound thereover, respectively, third chain 144A and fourth chain 144B. Additionally, third chain 144A and fourth chain 144B are connected, respectively, to first side edge 40A and second side edge of 40B of second movable panel 40, and, respectively, to vertically disposed first and second equally sized counterweights 92A and 92B.

In the preferred embodiment with first and second movable panels 30 and 40, first and second rods 130 and 140 are operatively connected by a gear mechanism 160. Gear mechanism 160 is shown in FIG. 3 to facilitate understanding the location thereof, but discussed below in more detail in connection with FIG. 8.

Figure 4A:
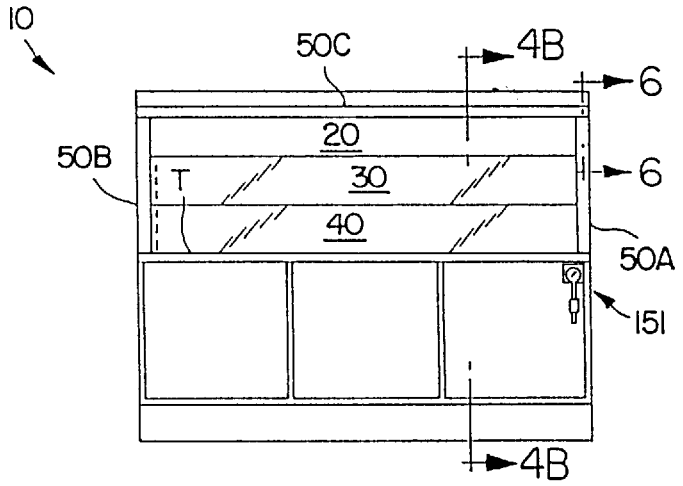
FIG. 4A is a rear, elevational view of the security window of FIG. 2, with the panels in the closed position.
Figure 4B:
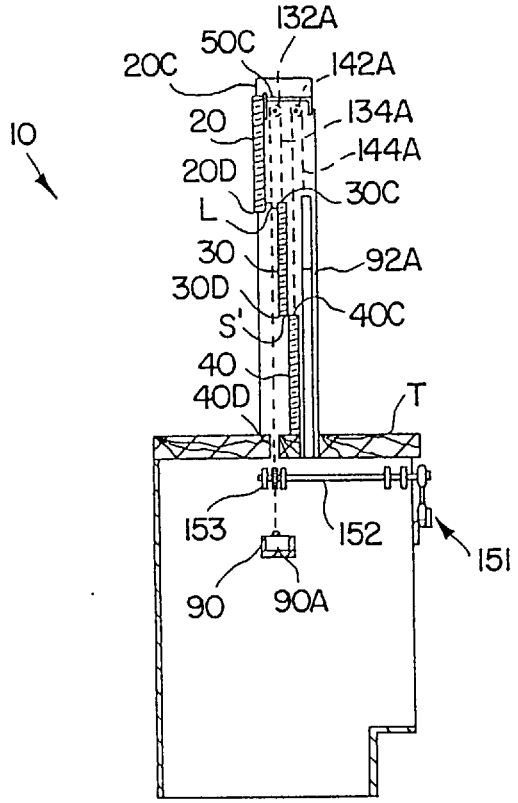
FIG. 4B is a vertical cross-sectional view taken along the line 4B—4B of FIG. 4A.
Figure 5A:
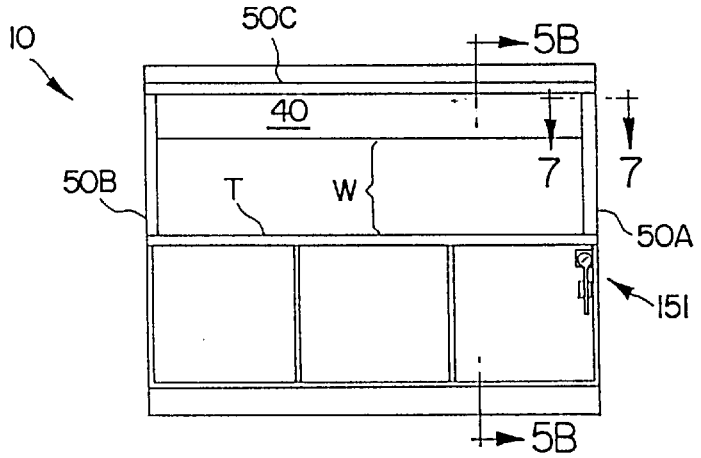
FIG. 5A is a rear, elevational view of the security window of FIG. 2, but with the panels in the open position.
Figure 5B:
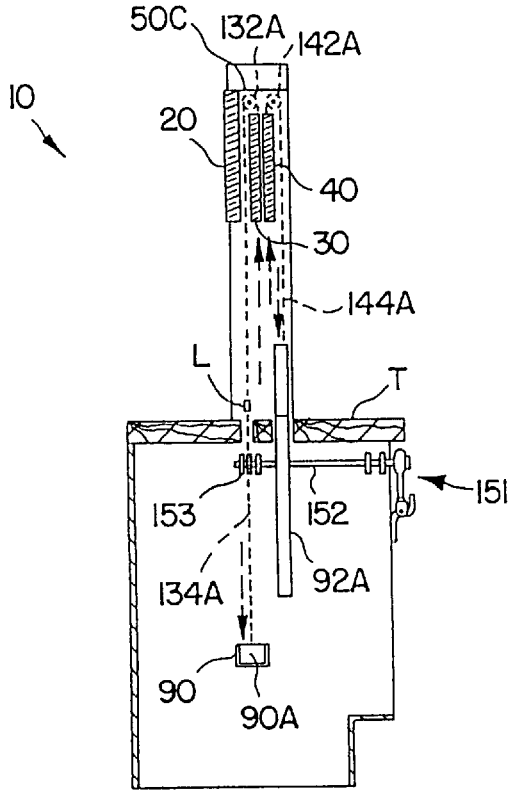
FIG. 5B is a vertical cross-sectional view taken along the line 5B—5B of FIG. 5A.

Moreover, positions of the various panels and counterweights can be better seen with reference to FIGS. 4A and 4B (security window 10 is closed) and FIGS. 5A and 5B (security window 10 is open).

More particularly, FIG. 4A is a rear elevational view of security window 10, and FIG. 4B is a cross-sectional, side view thereof taken along the line 4B—4B of FIG. 4A. FIGS. 4A and 4B show movable panels 30, 40 in the closed position.

As can be seen, fixed panel 20, first movable panel 30, and second movable panel 40, are all in imbricated relationship. Suitably, bottom edge 20D of fixed panel 20 and top edge 30A of first movable panel 30 overlap about 1 to 2 inches (about 2.5 to 5 cm), and likewise bottom edge 30D of first movable panel 30 and top edge 40A of second movable panel 40 overlap about 1 to 2 inches (about 2.5 to 5 cm), when movable panels 30, 40 are in the closed position. These overlapping portions may touch; however, it is preferred that they are spaced apart about 0.25 inch (about 0.635 cm) to about 0.50 inch (about 1.27 cm) so that when security window 10 is closed, the clerk and customers may converse without the necessity for an intercom system. The spacing apart should not be large enough to allow a robber to insert a gun therethrough.

When first movable panel 30 and second movable panel 40 are moved downwardly to their respective lower positions to place security window 10 in the closed position, as is illustrated in FIG. 4B, portions of bottom edge 30D of first movable panel 30 will come to rest on first and second stops S', S" (see FIG. 3) disposed, respectively, in first side member 50A and second side member 50B approximately midway between countertop T and bottom edge 20D of fixed panel 20. As a result, first movable panel 30 is approximately midway between fixed panel 20 and second movable panel 40. However, second movable panel 40 moves all the way down to countertop T so that bottom edge 40D of second movable panel 40 contacts countertop T.

Figure 4C:
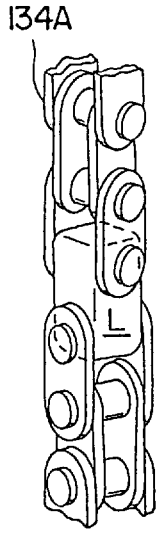
FIG. 4C is an enlarged, perspective view of the linkage element in FIG. 4B.

FIG. 4C provides an enlarged, perspective view of chain 134A which is provided with a linkage element L that allows for turning of the chain by 90 degrees. If desired, similar linkage elements L (not illustrated) may be provided for 90 degree turning of other chains 134B, 144A, and 144B.

FIG. 5A is a rear elevational view of security window 10, and FIG. 5B is a cross-sectional view thereof taken along the line 5B—5B of FIG. 5A. FIGS. 5A and 5B illustrate movable panels 30, 40 of security window 10 in the opened position.

As can be seen, fixed panel 20, first movable panel 30, and second movable panel 40 are in substantially parallel relationship, and respective bottom edges 20D, 30D, and 40D are generally aligned, leaving open space W. Typically, bottom edges 20D, 30D, and 40D will be about 36 inches (about 91 cm) above countertop T, which will allow for ease of conversing between the clerk and the customer generally without the need for looking through portions of panels 20, 30, and 40 when security window 10 is opened.

The following is noted with regard to the positions of the counterweights, when comparing FIGS. 4B and 5B. More specifically, when security window 10 is in its closed position, as illustrated in FIG. 4B, counterweight 90, which is associated with first movable panel 30, is in its uppermost position, suitably about 6 inches (about 15 cm) below countertop T. Additionally, counterweights 92A and 92B, which are associated with second movable panel 40, are also in their uppermost position, suitably with a portion thereof above countertop T and a portion thereof beneath countertop T. Typically, most of each of counterweights 92A and 92B will be above countertop T.

On the other hand, when security window 10 is in its opened position as illustrated in FIG. 5B, then counterweight 90, which is associated with first movable panel 30, is in its lowermost position, typically about 24 inches (about 46 cm) beneath countertop T, thereby leaving about 10–12 inches (about 56 cm) underneath counterweight 90 for wiring or other construction (not illustrated). Likewise, counterweights 92A, 92B (see FIG. 3), which are associated with second movable panel 40, are in their lowermost position so as to leave about 6 inches (about 15 cm) thereunder for any wiring or other construction (not illustrated).

Lastly in connection with FIGS. 4B and 5B, an activator 151 is operatively associated with movable panels 30 and 40 of assemblage 25, such that engagement of activator 151 allows for vertical movement thereof. Activator 151 is conventionally illustrated as a ratchet having an associated shaft 152 and sprocket 153 which engages chain 134A. Although activator 151 is illustrated as a ratchet for manual movement of assemblage 25, activator 151 may also be an electric motor for movement, or a combination thereof as a matter of design choice. If an electric motor is used, it should be battery operated (and the battery continually recharged) in the event a robber disconnects the electricity supplied to the business wherein security window 10 is located.

Figure 6:
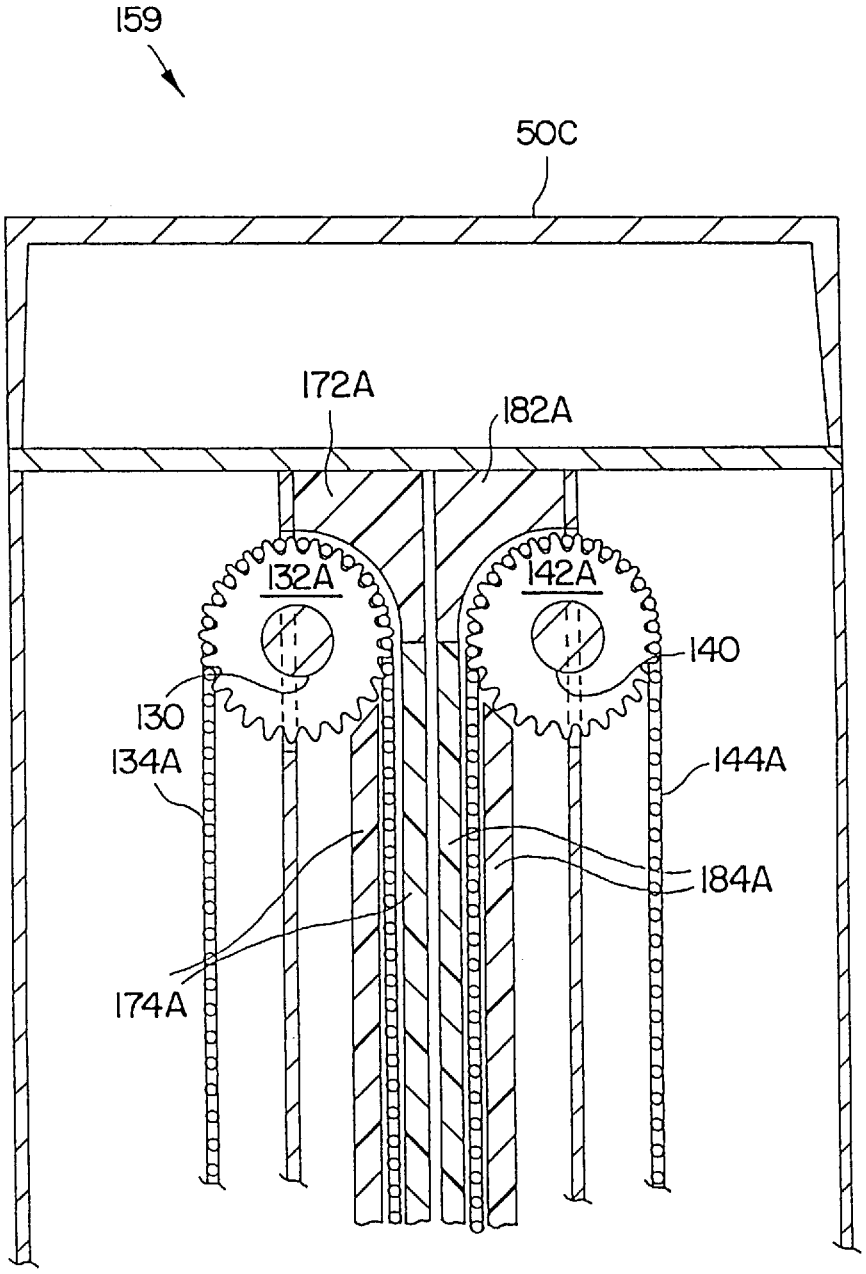
FIG. 6 is an enlarged vertical cross-sectional view taken along the line 6—6 of FIG. 4A to illustrate better the shaped block associated with each sprocket and the channel associated with each chain.
Figure 7:
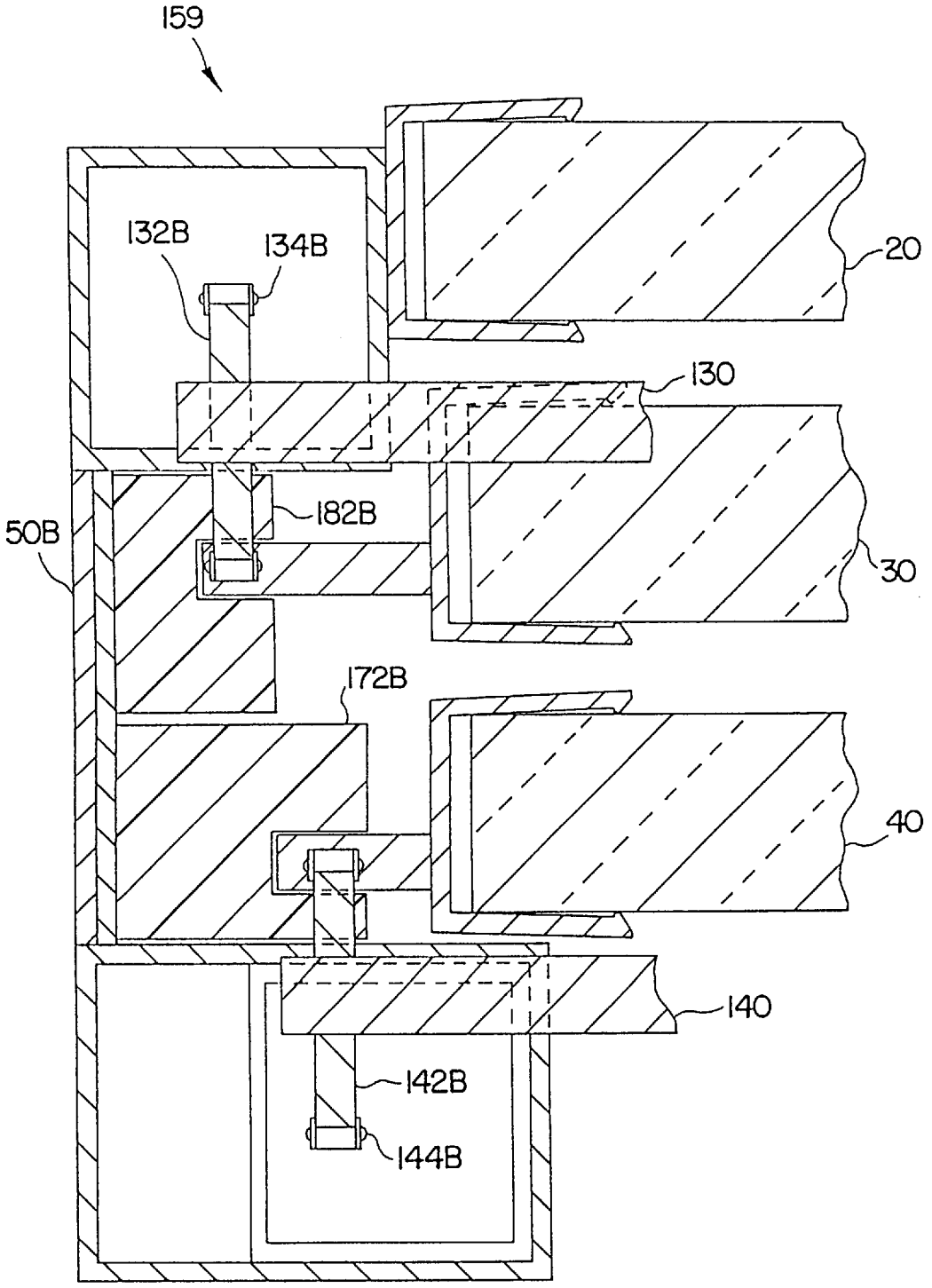
FIG. 7 is an enlarged horizontal cross-sectional view taken along the line 7—7 of FIG. 5A also to illustrate better the shaped block associated with each sprocket and the channel associated with each chain.

Referring now to FIGS. 6 and 7, it is noted that FIG. 6 is an enlarged vertical cross-sectional view taken along the line 6—6 of FIG. 4A, and FIG. 7 is an enlarged, cross-sectional view taken along the line 7—7 of FIG. 5A. It is noted that FIGS. 6 and 7 illustrate elements in or adjacent first side member 50A of frame 50. The elements of the opposing second side member 50B of frame 50 are identical to those shown in FIGS. 6 and 7 and thus not illustrated herein.

Illustrated in FIGS. 6 and 7 is a safety mechanism 159 which is operatively associated with the movable panels and adapted to prevent direct vertical manual movement thereof. In the preferred embodiment (see FIG. 8), safety mechanism 159 also includes gear mechanism 160 and ratchet 151 (see FIG. 9).

By "direct vertical manual movement" is meant movement vertically up and/or down of the one or more moveable panels by a person, such as a robber, placing hands, a club, or the like directly in contact with one or more of the movable panels in an attempt to move them up and/or down, as opposed to movement thereof vis-a-vis the above-described activator 151 and mounting mechanism 100. Therefore, when security window 10 is closed, safety mechanism 159 will not allow for direct vertical manual movement upwardly of the movable panels by a robber trying to open security window 10.

For clarity in explaining safety mechanism 159, it is first reiterated that first rod 130, first and second sprockets 132A and 132B, and first and second chains 134A and 134B are associated with first movable panel 30.

Safety mechanism 159 includes a first arcuate-shaped block 172A associated with first sprocket 132A and a first channel 174A associated with first chain 134A, and correspondingly, a second arcuate-shaped block 172B associated with second sprocket 132B and a second channel 174B associated with second chain 134B.

More particularly, first arcuate-shaped block 172A is disposed in first side member 50A and positioned near roof member 50C and above first sprocket 132A to prevent first chain 134A from being lifted off its respective first sprocket 132A during attempted direct rapid vertical manual movement of first movable panel 30. Likewise second arcuate-shaped block 172B is disposed in second side member 50B and positioned near roof member 50C and above second sprocket 132B to prevent second chain 134B from being lifted off its respective second sprocket 132B during attempted direct rapid vertical manual movement of first movable panel 30.

First channel 174A is disposed in first side member 50A, and first channel 174A is dimensioned to permit respective travel therein of first chain 134A but to prevent first chain 134A from buckling during attempted direct vertical manual movement of first movable panel 30. Likewise, second channel 174B is disposed in second side member 50B, and second channel 174B is dimensioned to permit respective travel therein of second chain 134B but to prevent second chain 134B from buckling during attempted direct vertical manual movement of first movable panel 30.

Also, with respect to second movable panel 40 in the preferred embodiment of security window 10, the following are provided for safety mechanism 159. For clarity in explaining the preferred embodiment, it is reiterated that second shaft 140, third and fourth sprockets 142A and 142B, and third and fourth chains 144A and 144B are associated with second movable panel 40.

For the preferred embodiment with second movable panel 40, safety mechanism 159 also includes a third arcuate-shaped block 182A, a fourth arcuate-shaped block 182B, a third channel 184A, and a fourth channel 184B.

More particularly, third arcuate-shaped block 182A is disposed in first side member 50A, and positioned near roof member 50C and above third sprocket 142A to prevent third chain 144A from being lifted off its respective third sprocket 142A during attempted direct vertical manual movement of second movable panel 40. Likewise, fourth arcuate-shaped block 182B is disposed in second side member 50B, and positioned near roof member 50C and above fourth sprocket 142B to prevent fourth chain 144B from being lifted off its respective fourth sprocket 142B during attempted direct vertical manual movement of second movable panel 40.

Third channel 184A is provided for third chain 144A, with third channel 184A being disposed in first side member 50A. Third channel 184A is dimensioned to permit respective travel therein of third chain 144A but to prevent third chain 144A from buckling during attempted direct vertical manual movement of second movable panel 40. Likewise, fourth channel 184B is provided for fourth chain 144B, with fourth channel 184B being disposed in second side member 50B. Fourth channel 184B is dimensioned to permit respective travel therein of fourth chain 144B but to prevent fourth chain 144B from buckling during attempted direct vertical manual movement of second movable panel 40.

Figure 8:
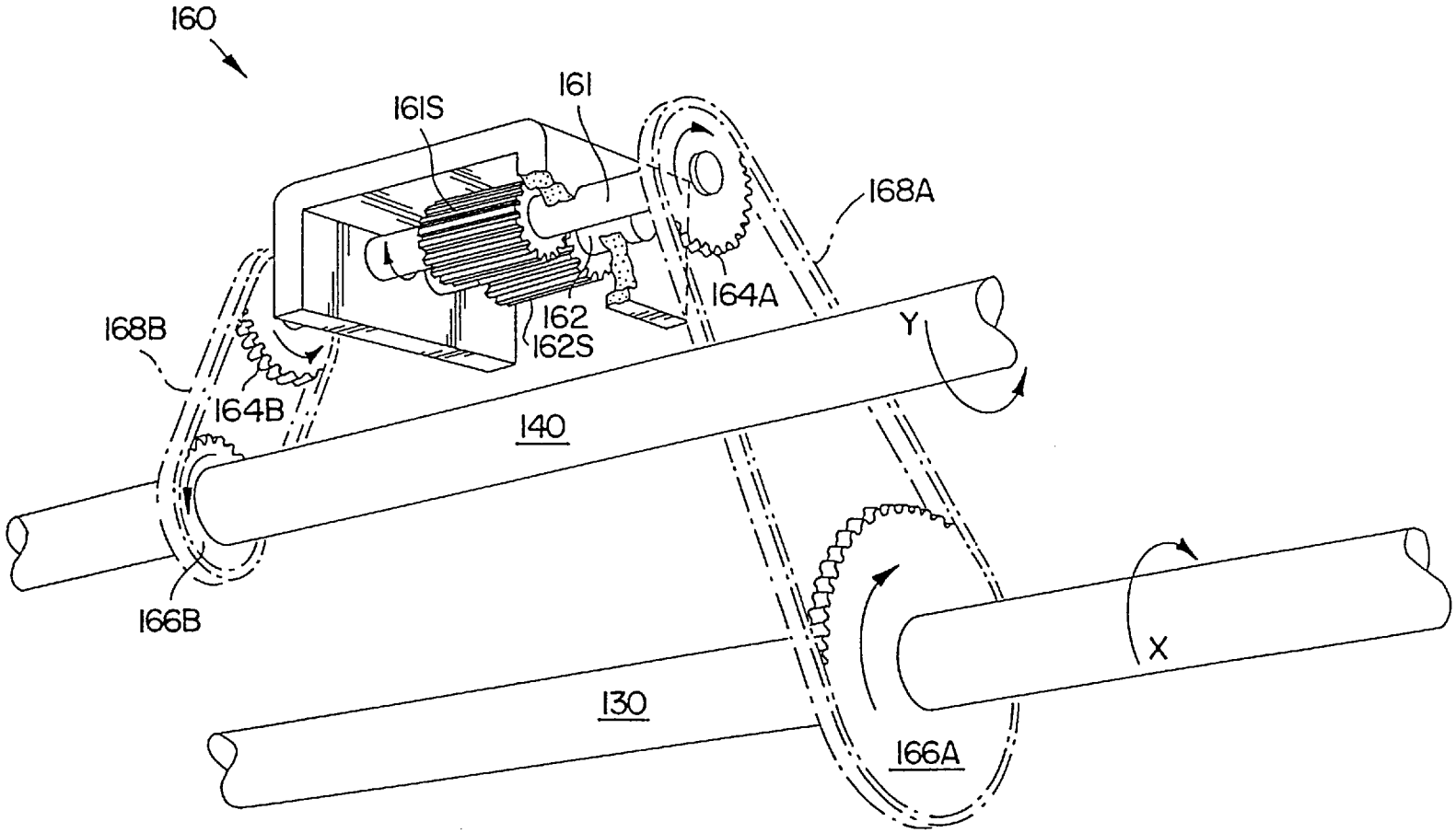
FIG. 8 is an enlarged view of the gear mechanism as can be seen at the top of the security window as shown in FIG. 3.

Specifically with regard to FIG. 8, in the preferred embodiment of security window 10 with first and second movable panels 30 and 40, safety mechanism 159 also includes gear mechanism 160, with a 2:1 gear ratio, which has a primary function to allow second movable panel 40 to move twice as far as first movable panel 30 during activation of security window 10.

More particularly, gear mechanism 160 interconnects first shaft 130 (which is associated with first movable panel 30) with second shaft 140 (which is associated with second movable panel 40) as follows. Gear mechanism 160 includes two rotatable shafts 161 and 162 with associated equal sized intermeshing spur gears 161S and 162S. Shaft 161 has mounted on one end sprocket 164A and shaft 162 has mounted on the opposite end sprocket 164B. Additionally, a first shaft sprocket 166A is provided on first shaft 130 and a second shaft sprocket 166B is provided on second shaft 140.

First shaft sprocket 166A on first shaft 130 is operatively connected with first gear sprocket 164A by way of first chain 168A being wound around the two sprockets. Likewise, second shaft sprocket 166B on second shaft 140 is operatively connected with second gear sprocket 164B by way of second chain 168B being wound around the two sprockets. As a result, attempted vertical upward manual movement of one or both of first and second movable panels 30 and 40 causes rotation of both of shafts 130 and 140 away from each other in the direction, respectively, of arrows X and Y (see FIG. 8), whereby chains 134A, 134B, 144A, and 144B lock in place since they cannot (1) buckle due to channels 174A, 174B and 184A, 184B; (2) lift off their respective sockets due to blocks 172A, 172B and 182A, 182B; or (3) move linearly due to ratchet 151 which locks under countertop T due to its spring loaded handle 151A (see FIG. 9).

Thus, if a would be robber attempts to pry up panel 40, safety mechanism of security window 10 functions as follows:

1. Raising panel 40 slightly upwardly causes chains 144A and 144B to move;
2. Because of chain guides 184A and 184B, the chain cannot buckle;
3. Because of blocks 182A and 182B, the chains cannot be lifted off sprockets 142A and 142B;
4. Thus, shaft 140 is caused to rotate;
5. Shaft 140 is interconnected with shaft 130 by means of gear box 160;
6. Therefore, any rotation of shaft 140 causes counter-rotation of shaft 130;
7. Rotation of shaft 130 causes a movement of chains 134A and 134B such that panel 30 will move in an upward direction and counterweight 90 moves down;

8. Sprocket 153 which engages chain 134A will be caused to rotate;
9. This rotation causes shaft 152 and ratchet 151 to rotate;
10. Ratchet 151 includes a spring loaded spinner handle 151A and locking pin 151B (see FIG. 9); and
11. Since ratchet and spinner handle assembly 151 is positioned in its inoperative mode with the locking pin 151B adjacent to the underside of countertop T, the rotating ratchet 151 will contact and lock against the underside of countertop T and prevent panels 30 and 40 from being forcibly raised.

Figure 9:
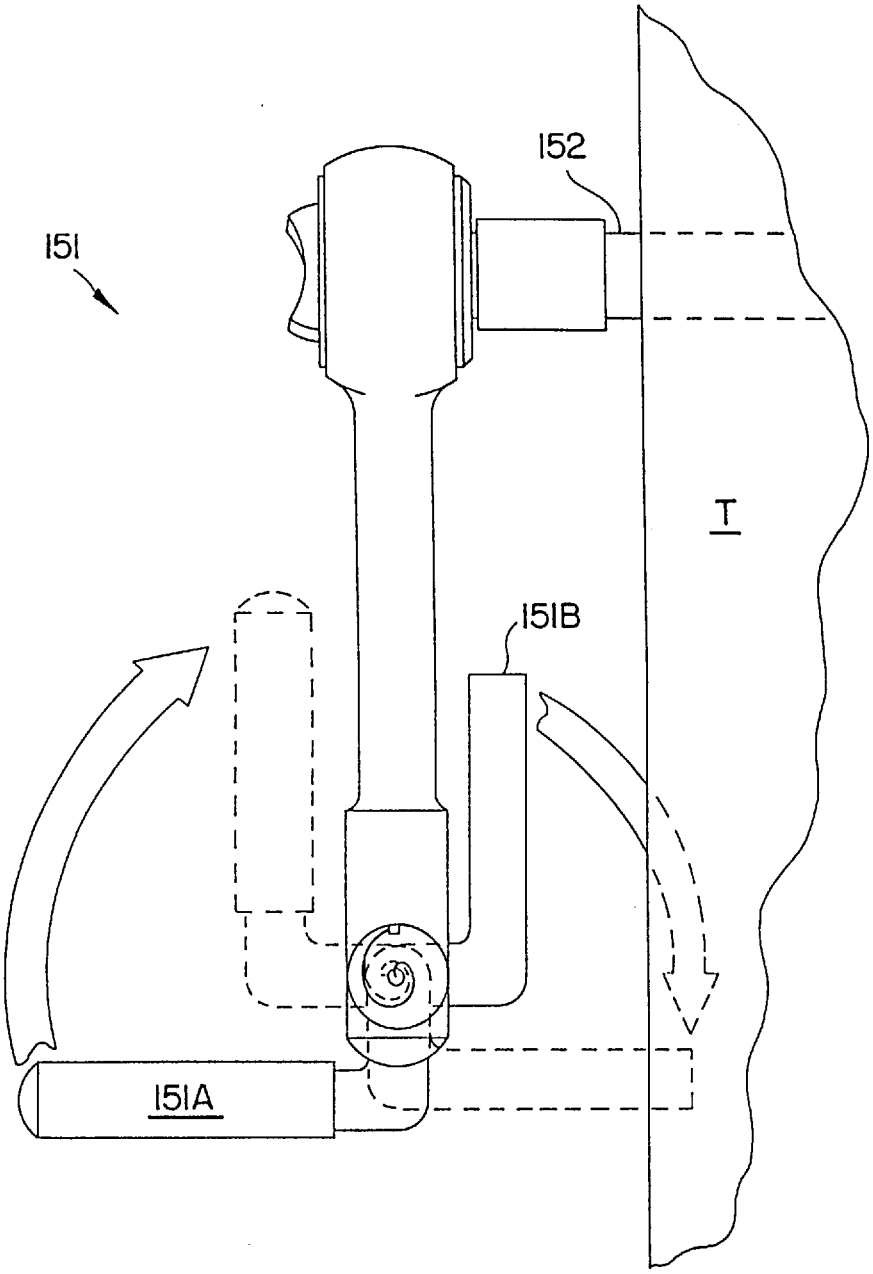
FIG. 9 is a top plan view of the ratchet actuator of the security window.

It will be understood and appreciated that when the operator manually cranks panels 30 and 40 up or down, he moves the spinner handle into position perpendicular to ratchet handle 151, as shown in FIG. 9. This causes the associated locking pin to be parallel to the ratchet and not to catch on countertop T when the entire assembly comprising spinner handle 151A, locking pin 151B, ratchet 151, shaft 152 and sprocket 153 is rotated. Once the operator releases spinner handle 151A, spring action urges the spinner handle to an operative position parallel and adjacent to ratchet 151 and this causes the locking pin 151B to protrude at ninety degrees (see FIG. 9) so as to engage the underside of countertop T if any further rotation of ratchet 151 occurs.

ALTERNATIVE EMBODIMENT

The discussion below is of an alternative embodiment of the invention as illustrated in FIGS. 10–16. The same numerals are used to depict the same elements in the different FIGS. 10–16.

Figure 10:
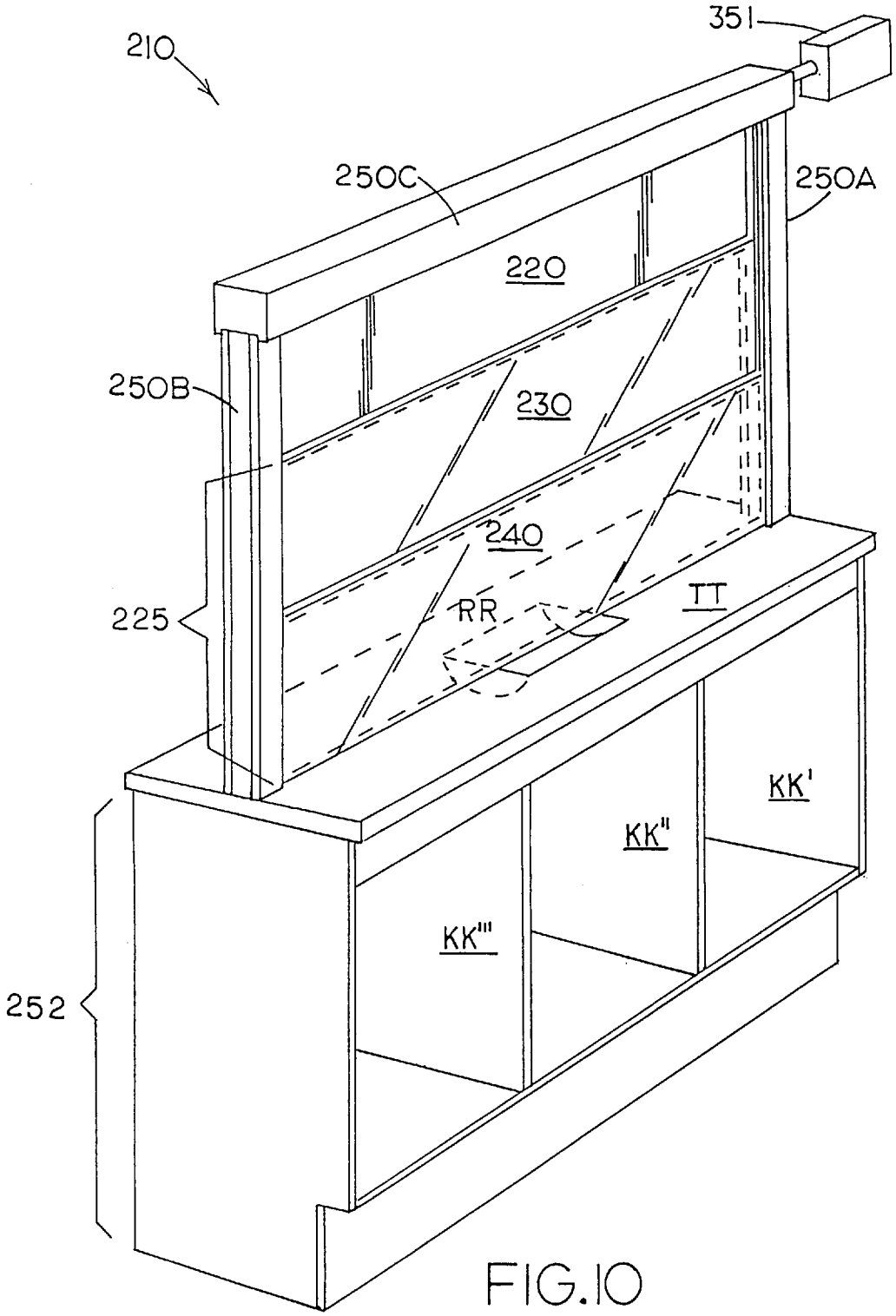
FIG. 10 is a rear perspective view of an alternative embodiment of the novel security window of FIG. 1.

More particularly, illustrated in FIG. 10 is a rear perspective view of security window 210.

Security window 210 has a transom or fixed panel 220 and a movable panel assemblage 225. Movable panel assemblage 225 comprises a first movable panel 230 and a second movable panel 240. As discussed in more detail below, the panels of assemblage 225 are adapted to move vertically downward from an upper open position to a lower closed position, and vice versa.

It is noted that although security window 210 is shown in its preferred embodiment with two movable panels 230 and 240, it is contemplated that security window 210 may have one movable panel or may have three or more movable panels as a matter of design choice.

Figure 11:
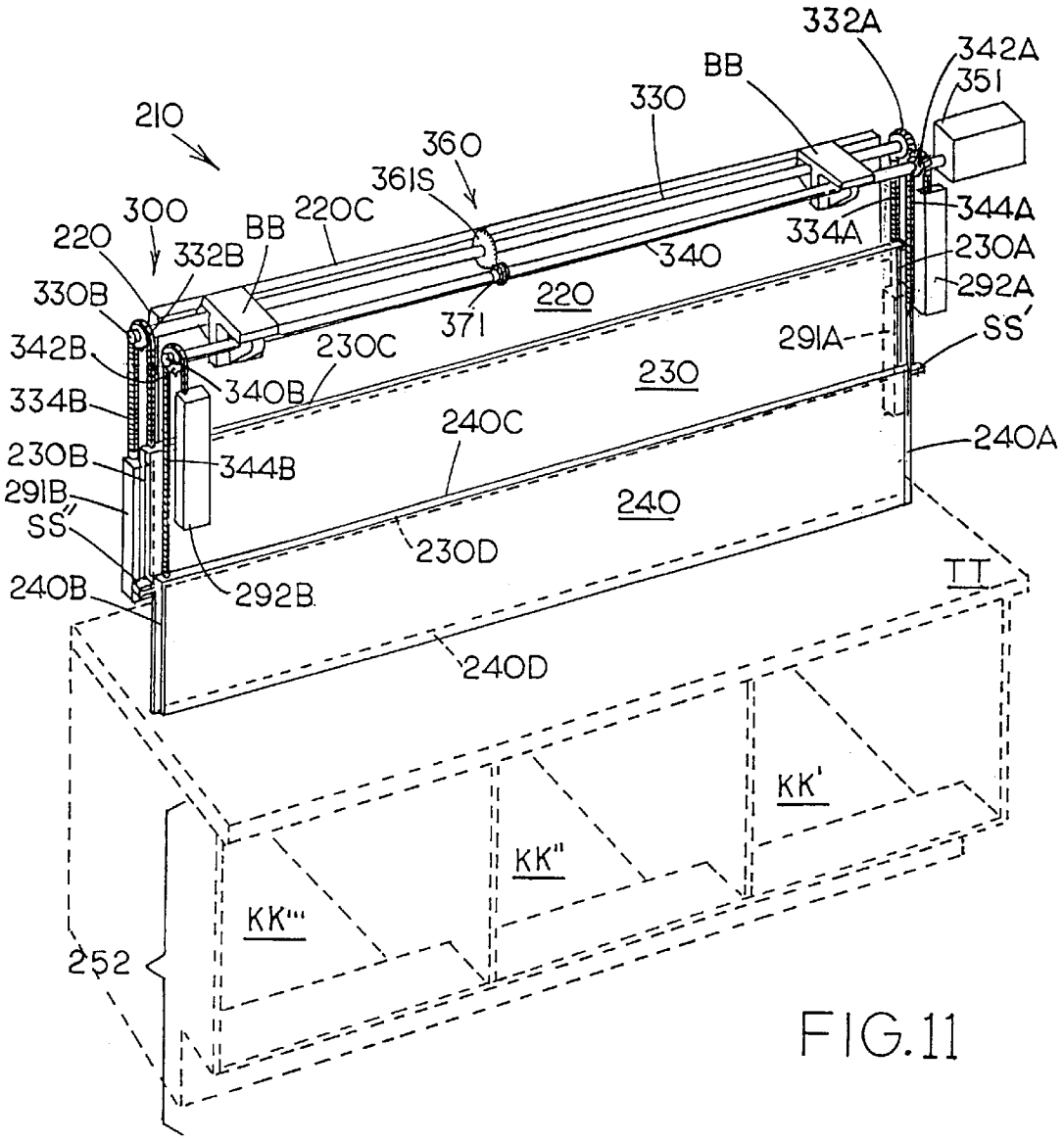
FIG. 11 is a rear perspective view of the security window of FIG. 10, but showing the working mechanism in solid lines absent the frame and showing the associated counter in phantom lines for better clarity of understanding.

FIG. 11 is a view of security window 210 illustrating greater detail thereof than FIG. 10 illustrates. For convenience in showing the greater detail, FIG. 11 does not show recess RR that is shown in countertop TT in FIG. 10, and also, FIG. 11 does not show first and second frame side members 250A, 250B and frame top member 250C that are shown in FIG. 10. Consequently, the working mechanism can be readily seen in FIG. 11, but the discussion of FIG. 11 should be considered in connection with FIG. 10 for references to the sides and the top of the frame.

More specifically, with regard to FIG. 11, transom or fixed panel 220 is fixedly mounted at each of its sides 220A, 220B to first side member 250A and second side member 250B, respectively, of frame 250. Additionally, each of first edge 230A and second edge 230B of first movable panel 230 is slidably mounted, respectively, in first side member 250A and second side member 250B of frame 250, and similarly, each of first edge 240A and second edge 240B of second movable panel 240 is slidably mounted, respectively, in first side member 250A and second side member 250B of frame 250.

Figure 12A:
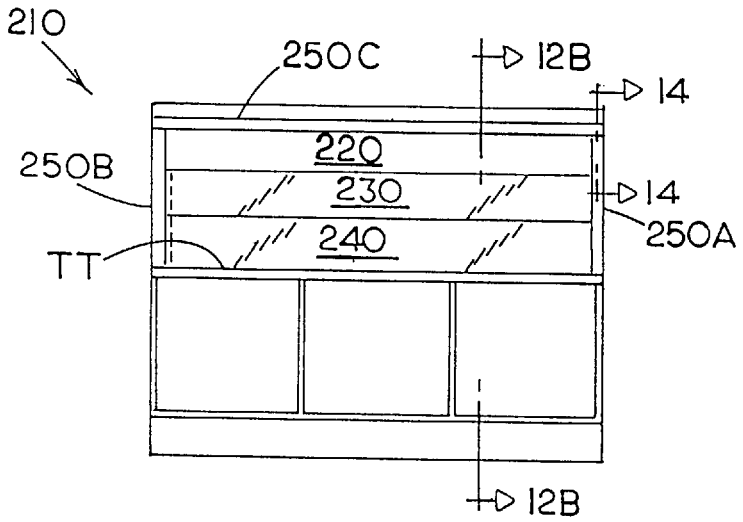
FIG. 12A is a rear elevational view of the security window of FIG. 10, with the panels in the closed position.
Figure 12B:
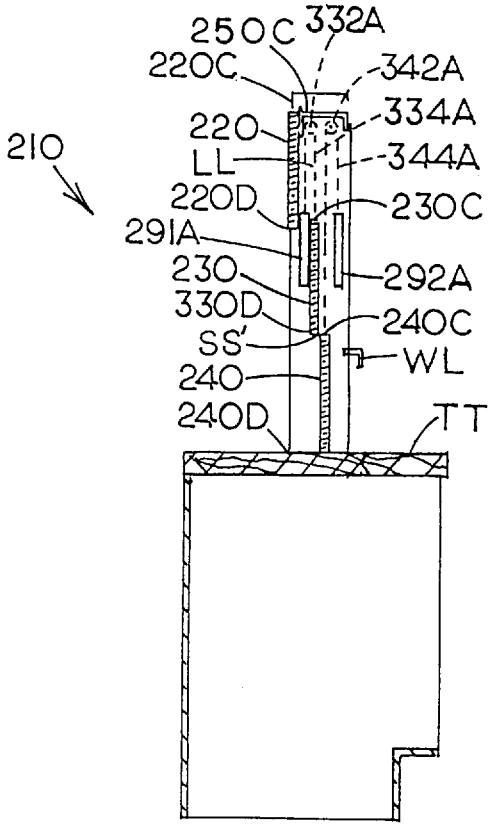
FIG. 12B is a vertical cross-sectional view taken along the line 12B—12B of FIG. 12A.
Figure 13A:
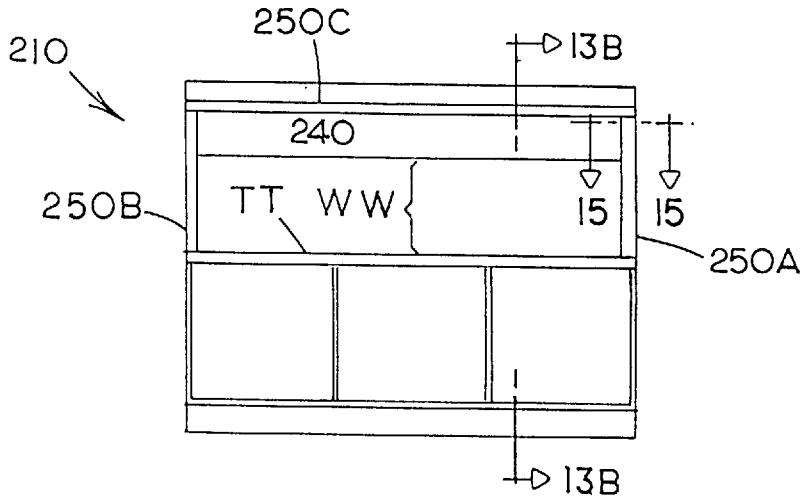
FIG. 13A is a rear elevational view of the security window of FIG. 10, but with the panels in the open position.
Figure 13B:
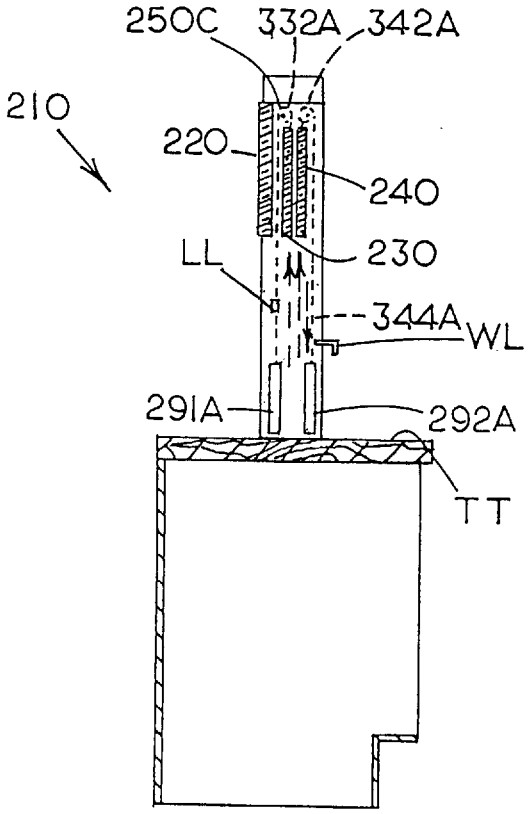
FIG. 13B is a vertical cross-sectional view taken along the line 13B—13B of FIG. 13A.

As a result, first and second movable panels 230, 240 are adapted to be vertically moved between a lower fully closed position (see FIGS. 12A and 12B) and an upper fully opened position (see FIGS. 13A and 13B). Movable panels 230, 240 can be moved vertically up or down, so that window 210 is fully open, partially opened or closed, or fully closed. First movable panel 230 and second movable panel 240 each vertically moves in a path defining a plane substantially parallel to the plane defined by fixed panel 220, and movement downwardly from the upper fully opened position to the lower fully closed position, or vice versa, takes about 5 to 7 seconds.

A counter balancing mechanism is provided for each of the one or more movable panels, and includes a primary counterweight assemblage for first movable panel 230. Primary counterweight assemblage comprises two equally sized first and second counterweights 291A and 291B, vertically disposed, respectively, in each of first side member 250A and second side member 250B of frame 250. For second movable panel 240, counter balancing mechanism 260 may further include a secondary counterweight assemblage comprising two equally sized first and second counterweights 292A and 292B vertically disposed, respectively, in each of first side member 250A and second side member 250B of frame 250. By "equally sized", it is meant that first and second equally sized primary counterweights 291A and 291B are generally of the same shape and same weight and that first and second equally sized secondary counterweights 292A and 292B are generally of the same shape and same weight.

Preferably, counterweights 291A, 292A, are exclusively within side member 250A, and counterweights 291B, 292B are exclusively within side member 250B. In other words, when movable panels 230, 240 are in their open, up position, then, counterweights 291A, 291B, 292A, 292B are still in the respective side members 250A, 250B, and not beneath frame 250 inside counter 252. Alternatively, if desired, cutouts (not shown) could be provided inside counter 252 and countertop TT, like those inside counter 52 and countertop T of security window 10 (see, FIGS. 2, 4B, and 5B) for the counterweights to move within the counter as they do in security window 10 when the panels are open. However, this is unnecessary for the alternative embodiment being described here, which affords greater ease of installation, as explained in more detail below.

A mounting mechanism 300 is operatively associated with frame 250 to permit vertical movement of the one or more movable panels, each in a path defining a plane substantially parallel to the plane defined by fixed panel 220. Thus, mounting mechanism 300 includes first shaft 330, first and second sprocket members 332A and 332B, and first and second chains 334A and 334B for first movable panel 230. Chain 334A is connected to shaft 352 of ratchet 351 in a conventional manner to be described in more detail below (similar to ratchet 151 in FIG. 3). Ratchet 351 may be mounted on the back side (i.e., the clerk side) of either of side members 250A, 250B of window 210 as a matter of design choice.

First shaft 330 has first end 330A and second end 330B, and is operatively associated with first movable panel 230. First shaft 330 is supported for rotational movement adjacent roof member 250C in mounting blocks BB.

First sprocket 332A and second sprocket 332B are disposed, respectively, at first end 330A and second end 330B of first shaft 330. Also, first sprocket 332A and second sprocket 332B have wound thereover, respectively, first chain 334A and second chain 334B. First chain 334A and second chain 334B are connected, respectively, to first side edge 230A and second side edge 230B of first movable panel 230, and, respectively, to vertically disposed first and second equally sized primary counterweights 291A, 291B.

For second movable panel 240, mounting mechanism 300 includes second shaft 340, third and fourth sprockets 342A and 342B, and third and fourth chains 344A and 344B.

Second shaft 340 has first end 340A and second end 340B, and is operatively associated with second movable panel 240. Second shaft 340 is supported for rotational movement adjacent roof member 250C in mounting blocks BB.

Third sprocket 342A and fourth sprocket 342B are disposed, respectively, at first end 340A and second end 340B of second shaft 340. Third sprocket 342A and fourth sprocket 342B have wound thereover, respectively, third chain 344A and fourth chain 344B. Additionally, third chain 344A and fourth chain 344B are connected, respectively, to first side edge 240A and second side edge of 240B of second movable panel 240, and, respectively, to vertically disposed first and second equally sized secondary counterweights 292A and 292B.

In the preferred embodiment with first and second movable panels 230 and 240, first and second shafts 330 and 340 are operatively connected by gear mechanism 360. Gear mechanism 360 is shown in FIG. 11 to facilitate understanding the location thereof, but discussed below in more detail in connection with FIG. 16.

Moreover, positions of the various panels and counterweights can be better seen with reference to FIGS. 12A and 12B (security window 210 is closed) and FIGS. 13A and 13B (security window 210 is open).

More particularly, FIG. 12A is a rear elevational view of security window 210, and FIG. 12B is a cross-sectional view thereof taken along line 12B—12B of FIG. 12A. FIGS. 12A and 12B show movable panels 230, 240 in the closed position. Optionally, a conventional window lock WL may be employed to lock movable panels 230, 240 when security window 210 is closed.

As can be seen, fixed panel 220, first movable panel 230, and second movable panel 240, are all in imbricated relationship. Suitably, bottom edge 220D of fixed panel 220 and top edge 230C of first movable panel 230 overlap about 1 to 2 inches (about 2.5 to 5 cm), and likewise bottom edge 230D of first movable panel 230 and top edge 240C of second movable panel 240 overlap about 1 to 2 inches (about 2.5 to 5 cm), when movable panels 230, 240 are in the closed position. These overlapping portions may touch; however, it is preferred that they are spaced apart about 0.25 inch (about 0.635 cm) to about 0.50 inch (about 1.27 cm) so that when security window 210 is closed, the clerk and customers may converse without the necessity for an intercom system. The spacing apart should not be large enough to allow a robber to insert a gun therethrough.

When first movable panel 230 and second movable panel 240 are moved downwardly to their respective lower positions to place security window 210 in the closed position, as is illustrated in FIG. 12B, portions of bottom edge 230D of first movable panel 230 will come to rest on first and second stops SS', SS" (see FIG. 11) disposed, respectively, in first side member 250A and second side member 250B approximately midway between countertop TT and bottom edge 220D of fixed panel 220. As a result, first movable panel 230 is approximately midway between fixed panel 220 and second movable panel 240. However, second movable panel 240 moves all the way down to countertop TT so that bottom edge 240D of second movable panel 240 contacts countertop TT.

Figure 12C:
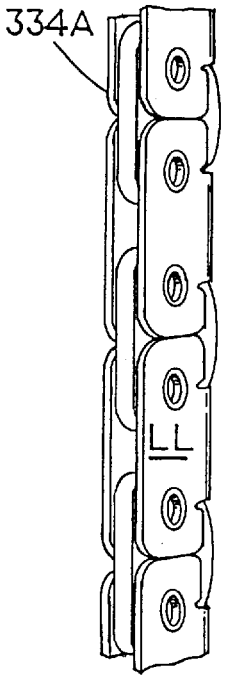
FIG. 12C is an enlarged, perspective view of the linkage element in FIG. 12B.

FIG. 12C provides an enlarged, perspective view of chain 334A which is provided with a linkage element LL that allows for turning of the chain by 90 degrees. If desired, similar linkage elements LL (not illustrated) may be provided for 90 degree turning of other chains 334B, 344A, and 344B.

Furthermore, in the alternative embodiment, each chain 334A, 334B, 344A, 344B is a uni-directional chain, which will, when fixed at two spaced-apart points along the chain (with the points defining a portion between the points and along the chain), become rigid in the portion of the chain between the two points to prevent buckling in that portion during attempted direct vertical manual movement of the movable panels. A suitable uni-directional chain may be purchased as CHAIN FLEX TYPE 10630™ from Blaine Window Hardware Company of Hagerstown, Md.

An instance of how a uni-directional chain works is one point is defined by where block 382A (see, FIG. 14) touches on chain 344A, and the other point is defined by the robber's hand (not shown) pushing on movable panel 240 which in turn pushes on chain 344A, and thus, is where panel 240 touches on chain 344A. Hence, the portion of chain 344A therebetween becomes rigid and will not buckle. Consequently, safety channels, like channels 174A, 174B, 184A, 184B (see FIG. 6 of the other embodiment for security window 10) are not necessary for this preferred version of the alternative embodiment.

FIG. 13A is a rear elevational view of security window 210, and FIG. 13B is a cross-sectional view thereof taken along the line 13B—13B of FIG. 13A. FIGS. 13A and 13B illustrate movable panels 230, 240 of security window 210 in the opened position.

As can be seen, fixed panel 220, first movable panel 230, and second movable panel 240 are in substantially parallel relationship, and respective bottom edges 220D, 230D, and 240D are generally aligned, leaving open space WW. Typically, bottom edges 220D, 230D, and 240D will be about 36 inches (about 91 cm) above countertop TT, which will allow for ease of conversing between the clerk and the customer generally without the need for looking through portions of panels 220, 230, and 240 when security window 210 is opened.

The following is noted with regard to the preferred positions illustrated for the counterweights, when comparing FIGS. 12B and 13B. More specifically, when security window 210 is in its closed position, as illustrated in FIG. 12B (and also in FIG. 11), counterweights 291A, 291B which are associated with first movable panel 230, are in their uppermost position, suitably about 25 inches (about 76 cm) above countertop TT. Additionally, counterweights 292A and 292B, which are associated with second movable panel 240, are also in their uppermost position, suitably about 38 inches (about 76 cm) above countertop TT.

On the other hand, when security window 210 is in its opened position as illustrated in FIG. 13B, then counterweights 291A, 291B, which are associated with first movable panel 230, are in their lowermost position, just above countertop TT. Likewise, counterweights 292A, 292B, which are associated with second movable panel 240, are in their lowermost position, typically just above countertop TT.

Because in the preferred embodiment, counterweights 291A, 291B, 292A, 292B are exclusively within side members 250A, 250B, even when security window 210 is in its open position (unlike counterweights 90, 92A, 92B for security window 10), security window 210 can be installed as a unitary item distinct from cabinet 252. This feature easily allows for cabinet 252 and countertop TT to be installed completely; and then, later, security window 210 can be installed. In contrast, it is more desirable to install security window 10, cabinet 52, and countertop T in conjunction with each other since counterweights 90, 92A, and 92B move within cabinet 52.

Lastly, in connection with FIGS. 12B and 13B, an actuator 351 is operatively associated with movable panels 230 and 240 of the movable panel assemblage, such that engagement of actuator 351 allows for vertical movement thereof. Actuator 351 is shown conveniently located on the clerk side of side 250A and may also be located on the clerk side of side 250B. Alternatively, the clerk side of each of sides 250A, 250B may be adapted (not shown) to receive actuator 351 so that activator can be moved to either side as desired. Actuator 351 is illustrated as operatively connected to shaft 340 which engages sprocket 342A and chain 344A. Actuator 351 can be a manually actuated mechanism for movement of panels 230, 240, or actuator 351 may also be an electric, hydraulic or pneumatic motor for movement as a matter of design choice. If an electric motor is used, it should be battery operated (and the battery continually recharged) in the event a robber disconnects the electricity supplied to the business wherein security window 210 is located.

Figure 14:
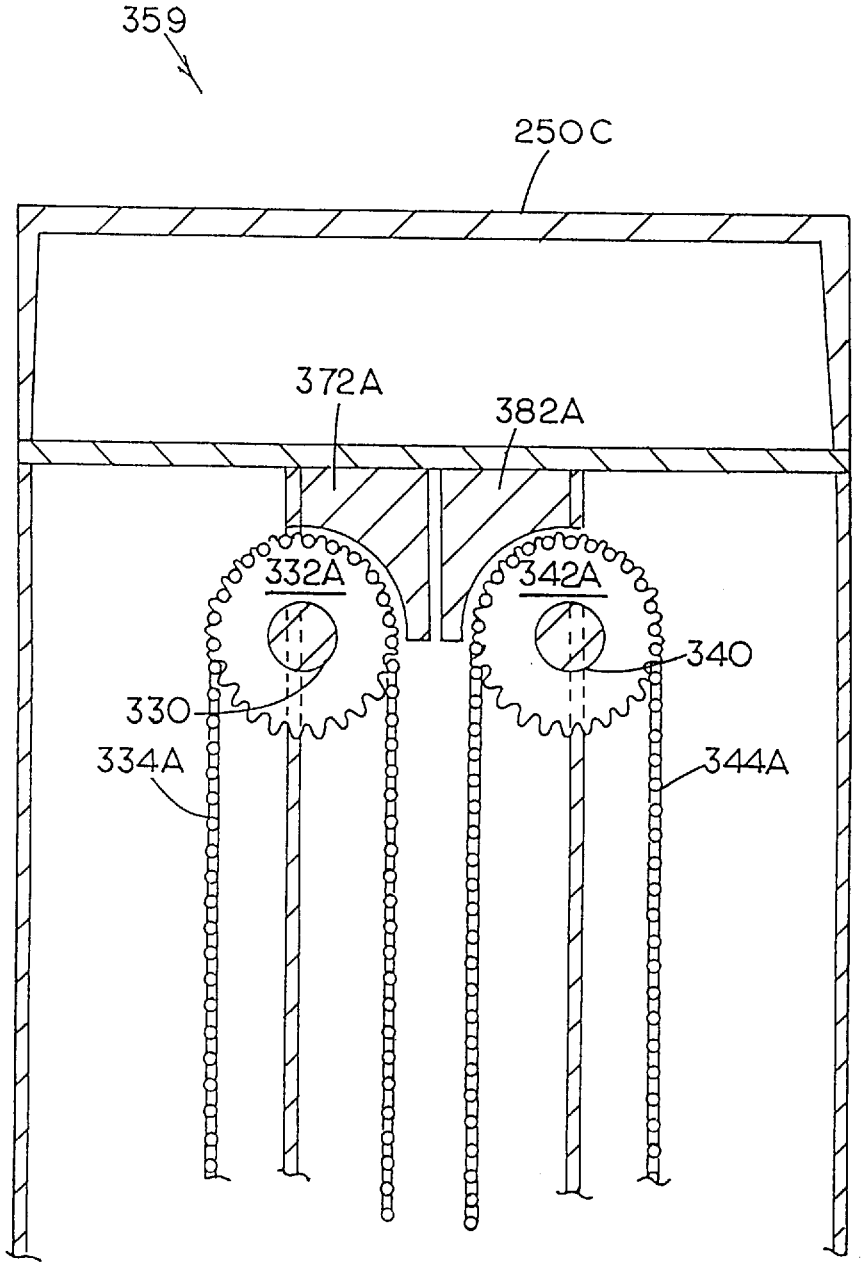
FIG. 14 is an enlarged vertical cross-sectional view taken along the line 14—14 of FIG. 12A to illustrate better the shaped block associated with each sprocket and with each chain.
Figure 15:
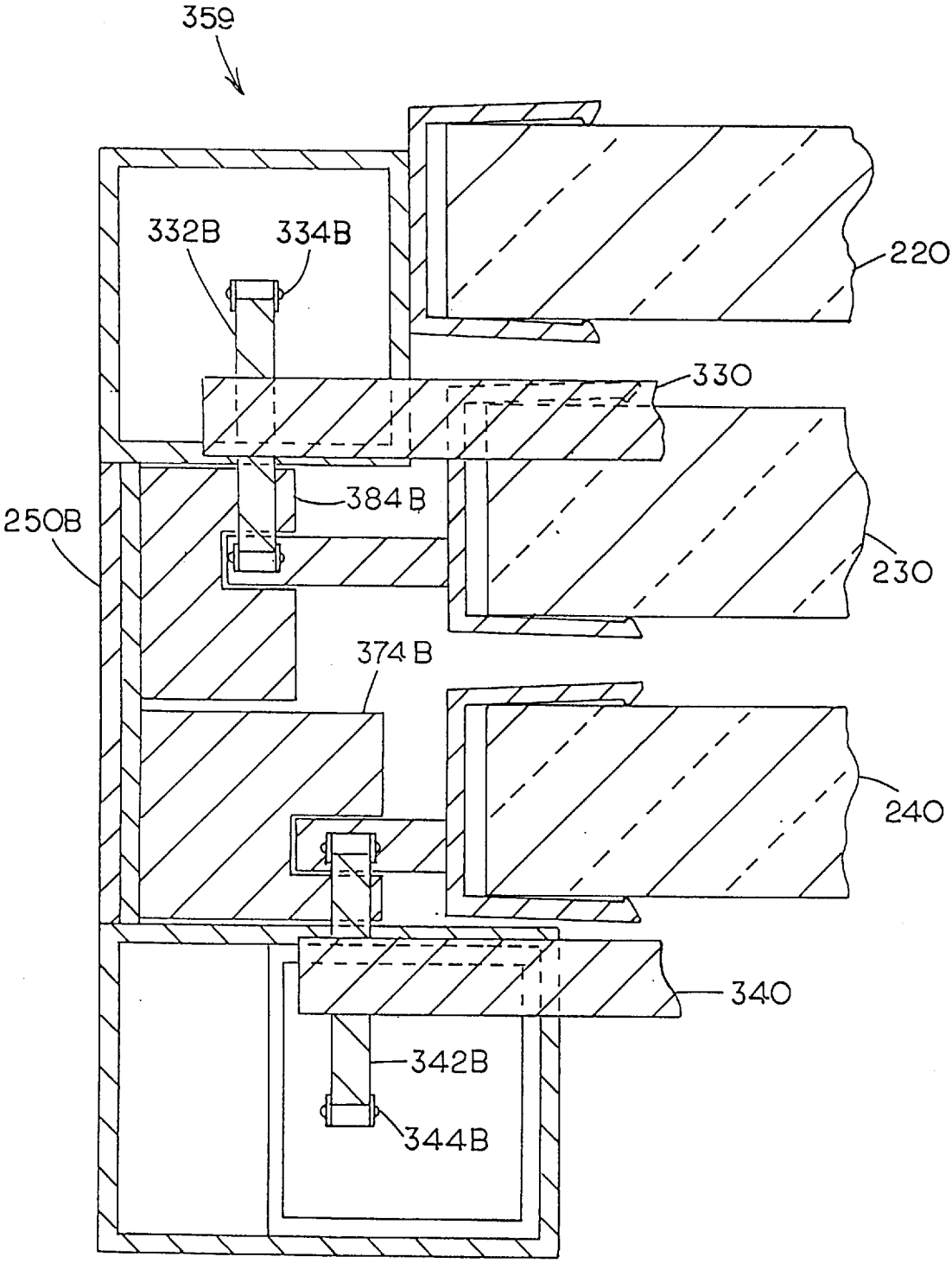
FIG. 15 is an enlarged horizontal cross-sectional view taken along the line 15—15 of FIG. 13A also to illustrate better the shaped block associated with each sprocket and with each chain.

Referring now to FIGS. 14 and 15, it is noted that FIG. 14 is an enlarged vertical cross-sectional view taken along the line 14—14 of FIG. 12A, and FIG. 15 is an enlarged, cross-sectional view taken along the line 15—15 of FIG. 13A. It is noted that FIGS. 14 and 15 illustrate elements in or adjacent first side member 250A of frame 250. The elements of the opposing second side member 250B of frame 250 are identical to those shown in FIGS. 14 and 15 and thus not illustrated herein.

Illustrated in FIGS. 14 and 15 is a safety mechanism 359 which is operatively associated with the movable panels and adapted to prevent direct vertical manual movement thereof. In the preferred embodiment, safety mechanism 359 also includes gear mechanism 360 (see FIG. 16) and actuator 351.

By "direct vertical manual movement" is meant movement vertically up and/or down of the one or more movable panels by a person, such as a robber, placing hands, a club, or the like directly in contact with one or more of the movable panels in an attempt to move them up and/or down, as opposed to movement thereof vis-a-vis the above-described actuator 351 and mounting mechanism 300. Therefore, when security window 210 is closed, safety mechanism 359 will not allow for direct vertical manual movement upwardly of the movable panels by a robber trying to open security window 210.

For clarity in explaining safety mechanism 359, it is first reiterated that first shaft 330, first and second sprockets 332A and 332B, and first and second chains 334A and 334B are associated with first movable panel 230.

Safety mechanism 359 includes a first arcuate-shaped block 372A associated with first sprocket 332A, and correspondingly, a second arcuate-shaped block 372B associated with second sprocket 332B. However, when, as described above, first and second chains 334A and 334B are uni-directional, channels 374A, 374B and 384A, 384B are unnecessary for safety mechanism 359 to prevent buckling of chains 334A, 334B during attempted direct vertical manual movement of movable panel 230. This is in contrast to first channel 174A associated with first chain 134A, and second channel 174B associated with second chain 134B for safety mechanism 159 to prevent buckling of chains 134A, 134B during attempted direct vertical manual movement of movable panel 30.

More particularly, first arcuate-shaped block 372A is disposed in first side member 250A and positioned near roof member 250C and above first sprocket 332A to prevent first chain 334A from being lifted off its respective first sprocket 332A during attempted direct rapid vertical manual movement of first movable panel 230. Likewise, second arcuate-shaped block 372B is disposed in second side member 250B and positioned near roof member 250C and above second sprocket 332B to prevent second chain 334B from being lifted off its respective second sprocket 332B during attempted direct rapid vertical manual movement of first movable panel 230. As a matter of design choice, one block with two arcuate-shaped portions (not shown) may be employed.

Also, with respect to second movable panel 240 in the preferred embodiment of security window 210, the following are provided for safety mechanism 359. For clarity in explaining the preferred embodiment, it is reiterated that second shaft 340, third and fourth sprockets 342A and 342B, and third and fourth chains 344A and 344B are associated with second movable panel 240.

For the preferred embodiment with second movable panel 240, safety mechanism 359 also includes a third arcuate-shaped block 382A and a fourth arcuate-shaped block 382B.

More particularly, third arcuate-shaped block 382A is disposed in first side member 250A, and positioned near roof member 250C and above third sprocket 342A to prevent third chain 344A from being lifted off its respective third sprocket 342A during attempted direct vertical manual movement of second movable panel 240. Likewise, fourth arcuate-shaped block 382B is disposed in second side member 250B, and positioned near roof member 250C and above fourth sprocket 342B to prevent fourth chain 344B from being lifted off its respective fourth sprocket 342B during attempted direct vertical manual movement of second movable panel 240. As a matter of design choice, one block with two arcuate-shaped portions (not shown) may be employed.

However, when, as described above, third and fourth chains 344A, 344B are uni-directional, channels are unnecessary to prevent buckling of chains 344A, 344B during attempted direct vertical manual movement of movable panel 240. This is in contrast to third and fourth channels 184A, 184B being disposed in first and second side members 50A, 50B to prevent third and fourth chains 144A, 144B from buckling during attempted direct vertical manual movement of second movable panel 40 of security window 10.

Figure 16:
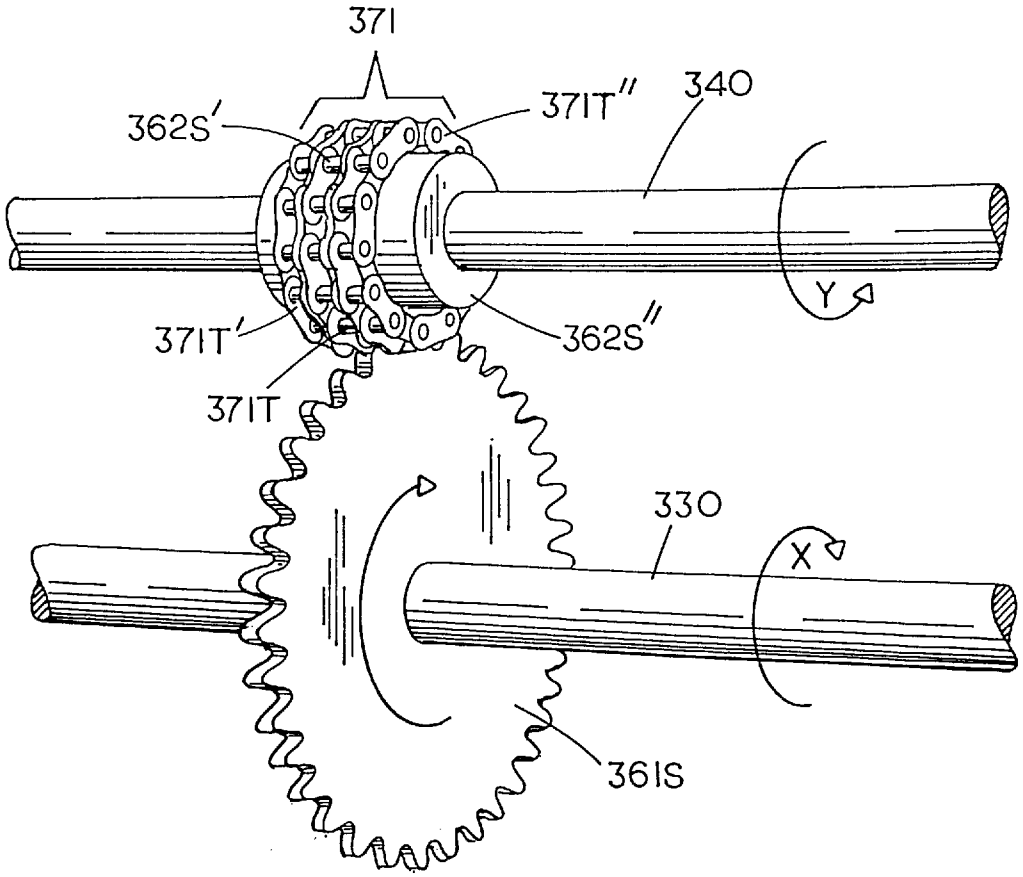
FIG. 16 is an enlarged view of the gear mechanism as can be seen at the top of the security window as shown in FIG. 11.

Specifically, with regard to FIG. 16, in the preferred embodiment of security window 210 with first and second movable panels 230 and 240, safety mechanism 359 also includes gear mechanism 360, with a 2:1 gear ratio, which has a primary function to allow second movable panel 240 to move twice as far as first movable panel 230 during activation of security window 210.

More particularly, gear mechanism 360 interconnects first shaft 330 (which is associated with first movable panel 230) with second shaft 340 (which is associated with second movable panel 240) as follows. Gear mechanism 360 includes large gear sprocket 361S on first shaft 330 and two small equal sized gear sprockets 362S' and 362S" on second shaft 340.

Large gear sprocket 361S has twice the diameter of one of small gear sprockets 362S', 362S". Large gear sprocket 361S is operatively connected with two small gear sprockets 362S', 362S" by way of 3-strand roller chain 371 with (A) the outside of middle strand 371T engaging the outside of the teeth of large gear sprocket 361S and (B) the inside of the two outer strands 371T', 371T", respectively, engaging the outsides of the teeth of small gear sprockets 362S', 362S".

As a result, attempted vertical upward manual movement of one or both of first and second movable panels 230 and 240 causes rotation of both of shafts 330 and 340 away from each other in the directions, respectively, of arrows X and Y (see FIG. 16), whereby chains 334A, 334B, 344A, 344B (see FIG. 14) lock in place since they cannot (1) buckle due to their being uni-directional; (2) lift off their respective sprockets due to blocks 372A, 372B and 382A, 382B; or (3) move linearly due to a conventional stop or lock (not shown) applied to panel 240.

Thus, if a would be robber attempts to pry up panel 240, safety mechanism of security window 210 functions as follows:

1. Panel 240 cannot be raised because it is disengageably locked by the conventional stop or lock;
2. Any attempt to raise panel 230 will cause chains 334A and 334B to move slightly;
3. Because of the chains being uni-directional, the chains cannot buckle;
4. Because of blocks 372A and 372B, the chains cannot be lifted off sprockets 332A and 332B;
5. Thus, shaft 340 is caused to rotate slightly;
6. Shaft 330 is interconnected with shaft 340 by means of gear mechanism 360;
7. Therefore, any rotation of shaft 330 causes counter-rotation of shaft 340;
8. Rotation of shaft 340 causes a movement of chains 344A and 344B such that panel 240 will attempt to move up but as panel 240 is locked down by the lock, it cannot move. Therefore, panel 230 also cannot be moved up.

It will be understood that various details of the invention may be changed without departing from the scope of the invention. Furthermore, the foregoing description is for the purpose of illustration only, and not for the purpose of limitation—the invention being defined by the claims.

What is claimed is:

1. A security window comprising:

(a) a frame having a roof member, a first side member, and a second side member;

(b) a vertically extending panel fixedly mounted adjacent to the roof member, and the fixed panel having a top edge, a bottom edge, a first side edge, and a second side edge;

(c) a vertically extending movable panel assemblage comprising at least one movable panel slidably mounted in the frame and adapted to be vertically moved between an upper open position in superposed registration with the fixed panel and a lower closed position vertically below the fixed panel, and the at least one movable panel having a top edge, a bottom edge, a first side edge, and a second side edge;

(d) a counterbalance for the movable panel assemblage including a primary counterweight assemblage comprising a first and a second equally sized counterweight vertically disposed, respectively, in each of the first and the second side members of the frame;

(e) a mounting mechanism operatively associated with the frame to permit vertical movement of the at least one movable panel in a path that defines a plane substantially parallel to the plane defined by the fixed panel, wherein the mounting mechanism includes:

(i) a first shaft, having a first end and a second end, and the first shaft being operatively associated with the at least one movable panel and being supported for rotational movement adjacent the roof member of the frame;

(ii) a first and a second sprocket disposed, respectively, at the first end and the second end of the first shaft; and (iii) a first and a second chain connected, respectively, to the first and the second side edges of the at least one movable panel, and connected to the primary counterweight assemblage, and wound, respectively, over the first and the second sprockets;

(f) an activator operatively associated with the movable panel assemblage, such that engagement of the activator with the mounting mechanism allows for vertical movement of the at least one movable panel; and (g) a safety mechanism operatively associated with the movable panel assemblage and adapted to prevent direct vertical manual movement of the at least one movable panel, wherein the safety mechanism includes a first and a second arcuate-shaped block respectively disposed in each of the first and the second side members, with the first and the second blocks being respectively positioned above each of the first and the second sprockets to prevent each of the first and the second chains from being lifted off its associated sprocket during attempted direct vertical manual movement of the at least one movable panel.

2. The security window of claim 1, wherein the panels are provided with bullet-resistant characteristics.

3. The security window of claim 2, wherein each of the panels is manufactured from a transparent material, such that the transparent material provides bullet-resistant characteristics to the security window.

4. The security window of claim 1, wherein the frame is mounted on a countertop.

5. The security window of claim 4, wherein the countertop has a recess disposed therein beneath the panels, the recess being for passing items from one side to another side of the security window when the at least one movable panel is in the closed position.

6. The security window of claim 1, wherein the fixed panel and the at least one movable panel are in substantially parallel relationship when the movable panel is in the open position, and are in substantially imbricated relationship when the movable panel is in the closed position.

7. The security window of claim 1, wherein the activator comprises a mechanism for manual movement of the movable panel assemblage.

8. The security window of claim 1, wherein the first and the second primary counterweights are each exclusively disposed, respectively, in the first and the second side members of the frame.

9. The security window of claim 1, wherein each of the first and the second chains is a uni-directional chain which will, when fixed at two spaced-apart points along the chain and defining a portion therebetween along the chain, become rigid in the portion of the chain between the two points to prevent buckling in that portion during attempted direct vertical manual movement of the at least one movable panel.

10. The security window of claim 1, wherein each of the first and the second chains is capable of buckling, and the safety mechanism further includes a first channel for the first chain and a second channel for the second chain, with the first channel being disposed in the first side member and the second channel being disposed in the second side member, and each channel being dimensioned to permit respective travel therein of each associated chain freely about its associated sprocket but to prevent each chain from buckling during attempted direct vertical manual movement of the movable panel.

11. The security window of claim 1, wherein:

the movable panel assemblage further comprises a second vertically extending movable panel slidably mounted in the frame and adapted to be vertically moved between an upper open position and a lower closed position, and the second movable panel having a top edge, a bottom edge, a first side edge, and a second side edge;

the counterbalance further includes a secondary counterweight assemblage comprising a first and a second equally sized counterweight vertically disposed, respectively, in each of the first and the second side members of the frame;

the mounting mechanism further includes:

(i) a second shaft operatively associated with the second movable panel, the second shaft being supported for rotational movement adjacent the roof member and the second shaft having a first end and a second end;

(ii) a third and a fourth sprocket disposed, respectively, at the first end and the second end of the second shaft; and (iii) a third and a fourth chain connected, respectively, to the first and the second side edges of the second movable panel, and connected, respectively, to the first and the second equally sized secondary counterweights, and wound, respectively, over the third and the fourth sprockets; and the safety mechanism includes:

a first, a second, a third, and a fourth arcuate-shaped block, with the first and the third blocks being disposed in the first side member of the frame and the second and the fourth blocks being disposed in the second side member of the frame, and each of the first, second, third, and fourth blocks being positioned, respectively, above each of the first, second, third, and fourth sprockets to prevent each associated chain from being lifted off its associated sprocket during attempted direct vertical manual movement of one or both of the first and the second movable panels.

12. The security window of claim 11, wherein:

the frame is mounted on a countertop;

each of the first and the second movable panels and the fixed panel are approximately the same size;

the first and the second movable panels, when in the open position, and the fixed panel are in substantially parallel relationship; and the first and the second movable panels, when in the closed position, and the fixed panel are in imbricated relationship such that:

(i) portions of the bottom edge of the first movable panel contact first and second stoppers disposed, respectively, in the first and the second side members, whereby the first movable panel is approximately midway between the fixed panel and the second movable panel, and (ii) the bottom edge of the second movable panel is aligned with bottom ends of the first and the second frame side members.

13. The security window of claim 12, wherein the countertop has a recess disposed therein beneath the panels, the recess being for passing items from one side to another side of the security window when the movable panels are in the closed position.

14. The security window of claim 11, wherein:

(i) the first and the second primary counterweights are each exclusively disposed, respectively, in the first and the second side members of the frame, and (ii) the first and the second secondary counterweights are each exclusively disposed, respectively, in the first and the second side members of the frame.

15. The security window of claim 11, wherein each of the first, the second, the third, and the fourth chains is a unidirectional chain which will, when fixed at two spaced-apart points along the chain and defining a portion therebetween along the chain, become rigid in the portion of the chain between the two points to prevent buckling in that portion during attempted direct vertical manual movement of one or both of the first and the second movable panels.

16. The security window of claim 11, wherein each of the first, the second, the third, and the fourth chains is capable of buckling, and the safety mechanism further comprises a first, a second, a third, and a fourth channel, respectively, for each of the first, the second, the third, and the fourth chains, with the first and the third channels being disposed in the first side member of the frame and the second and the fourth channels being disposed in the second side member of the frame, and each channel being dimensioned to permit travel therein of each associated chain freely about its associated sprocket but to prevent each associated chain from buckling during attempted direct vertical manual movement of one or both of the first and the second movable panels.

17. The security window of claim 16, wherein: the safety mechanism further includes a gear mechanism interconnecting the first shaft, which is associated with the first movable panel, with the second shaft, which is associated with the second movable panel, and wherein the gear mechanism has a 2:1 gear ratio to allow the second movable panel to move twice as far as the first movable panel during activation of the security window.

18. The security window of claim 17, wherein the gear mechanism includes:

(i) a large gear sprocket disposed on the first shaft and two small equal sized gear sprockets disposed on the second shaft, and wherein, the large gear sprocket has twice the diameter of one of the small gear sprockets, and (ii) a 3-strand roller chain, having a middle strand and two outside strands, wherein the 3-strand roller chain operatively connects the large gear sprocket with the two small gear sprockets, with the outside of the middle strand engaging the outside of the large gear sprocket and the insides of the two outside strands, respectively, engaging the outsides of the two small gear sprockets, whereby attempted vertical upward manual movement of one or both of the first and the second movable panels causes rotation of both of the first and the second shafts away from each other.

19. The security window of claim 11, wherein the panels are provided with bullet-resistant characteristics.

20. The security window of claim 19, wherein each of the panels is manufactured from a transparent material, such that the transparent material provides bullet-resistant characteristics to the security window.

21. The security window of claim 11, wherein the fixed panel and the movable panels are in substantially parallel relationship when the movable panels are in the open position, and are in substantially imbricated relationship when the movable panels are in the closed position.

22. The security window of claim 21, wherein the imbricated relationship provides that:

(a) the bottom edge of the fixed panel and the top edge of the first movable panel (i) overlap from about 1 inch (about 2.54 cm) to about 2 inches (about 5.08 cm) and (ii) are spaced apart from about 0.25 inch (about 0.635 cm) to about 0.50 inch (about 1.27 cm); and (b) the bottom edge of the first movable panel and the top edge of the second movable panel (i) overlap from about 1 inch (about 2.54 cm) to about 2 inches (about 5.08 cm) and (ii) are spaced apart from about 0.25 inch (about 0.635 cm) to about 0.50 inch (about 1.27 cm).

23. The security window of claim 11, wherein the activator comprises a mechanism for manual movement of the movable panel assemblage.

24. The security window of claim 11, wherein the activator comprises a motorized mechanism for movement of the movable panel assemblage.

* * * * *